US012560365B2

(12) United States Patent
Wang et al.

(10) Patent No.: US 12,560,365 B2
(45) Date of Patent: Feb. 24, 2026

(54) AIR CONDITIONER AND METHOD FOR CALCULATING OPERATING PARAMETER OF INDOOR UNIT

(71) Applicant: QINGDAO HISENSE HITACHI AIR-CONDITIONING SYSTEMS CO., LTD., Shandong (CN)

(72) Inventors: Jiangnan Wang, Shandong (CN); Yanjin Che, Shandong (CN); Xingxiang Xia, Shandong (CN); Heng Zhang, Shandong (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 105 days.

(21) Appl. No.: 18/405,761

(22) Filed: Jan. 5, 2024

(65) Prior Publication Data

US 2024/0142148 A1 May 2, 2024

Related U.S. Application Data

(63) Continuation of application No. PCT/CN2022/103052, filed on Jun. 30, 2022.

(30) Foreign Application Priority Data

Apr. 29, 2022 (CN) ..... 202210467464.8
Apr. 29, 2022 (CN) ..... 202210474713.6

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/0233* (2013.01);
(Continued)

(58) Field of Classification Search
CPC ..... F25B 49/02; F25B 49/027; F25B 13/00; F25B 2313/0233; F25B 2313/0312;
(Continued)

(56) References Cited

U.S. PATENT DOCUMENTS

2020/0348064 A1 11/2020 Takenaka et al.
2022/0380648 A1* 12/2022 Kumakura ..... F25B 5/02
2023/0089608 A1 3/2023 Ren et al.

FOREIGN PATENT DOCUMENTS

CN 1344921 A 4/2002
CN 101089500 A 12/2007
(Continued)

OTHER PUBLICATIONS

International Search Report and Written Opinion dated Dec. 19, 2022 in corresponding International Application No. PCT/CN2022/103052, translated, 20 pages.
(Continued)

*Primary Examiner* — Miguel A Diaz
(74) *Attorney, Agent, or Firm* — MH2 TECHNOLOGY LAW GROUP, LLP

(57) ABSTRACT

An air conditioner and a method for calculating an operating parameter of an indoor unit are provided. The air conditioner includes an outdoor unit, an indoor unit, and a controller. The controller is configured to: in a case where the air conditioner is in a cooling state, determine an operating parameter of the indoor unit in a second cooling state according to a heat exchange area, a heat exchange coefficient, and a heat exchange temperature difference of an indoor heat exchanger; and determine an operating parameter of the indoor unit in a first cooling state according to a superheat degree of an outlet of the indoor heat exchanger in the first cooling state, a superheat degree of the outlet of the indoor heat exchanger in the second cooling state, and the operating parameter of the indoor unit in the second cooling state.

20 Claims, 7 Drawing Sheets

(52) U.S. Cl.
CPC ..... *F25B 2313/0312* (2013.01); *F25B 2313/0314* (2013.01); *F25B 2500/19* (2013.01)

(58) Field of Classification Search
CPC ..... F25B 2313/031; F25B 2313/0314; F25B 2500/19
See application file for complete search history.

(56) References Cited

FOREIGN PATENT DOCUMENTS

| | | | |
|---|---|---|---|
| CN | 103868624 | A | 6/2014 |
| CN | 104197432 | A | 12/2014 |
| CN | 105910220 | A | 8/2016 |
| CN | 106904058 | A | 6/2017 |
| CN | 109899931 | A | 6/2019 |
| CN | 110260452 | A | 9/2019 |
| CN | 110513818 | A | 11/2019 |
| CN | 110715466 | A | 1/2020 |
| CN | 113175733 | A | 7/2021 |
| CN | 114165899 | A | 3/2022 |
| JP | H1038398 | A | 2/1998 |
| JP | 2010261606 | A | 11/2010 |
| JP | 2014190554 | A | 10/2014 |

OTHER PUBLICATIONS

Chinese First Office Action dated Feb. 3, 2023 in corresponding Chinese Application No. 202210467464.8, translated, 15 pages.

* cited by examiner

AIR CONDITIONER AND METHOD FOR CALCULATING OPERATING PARAMETER OF INDOOR UNIT

CROSS-REFERENCE TO RELATED APPLICATIONS

This application is a continuation application of International Patent Application No. PCT/CN2022/103052, filed on Jun. 30, 2022, which claims priority to Chinese Patent Application No. 202210467464.8, filed on Apr. 29, 2022, and Chinese Patent Application No. 202210474713.6, filed on Apr. 29, 2022, which are incorporated herein by reference in their entireties.

TECHNICAL FIELD

The present disclosure relates to the field of air conditioning technologies and, in particular, to an air conditioner and a method for calculating an operating parameter of an indoor unit.

BACKGROUND

An accurate operating parameter (e.g., a sensible heat load during cooling and a sensible heat load during heating) of an indoor unit plays an important role in the control of a multi-split air conditioner. For example, a cooling capacity of a compressor and an opening degree of an electronic expansion valve are regulated according to the operating parameter of the indoor unit, so that the air conditioner may achieve energy conservation and emission reduction with a good cooling or heating effect.

SUMMARY

In an aspect, an air conditioner is provided. The air conditioner includes an outdoor unit, an indoor unit, and a controller. The outdoor unit includes a compressor, a four-way valve, an outdoor heat exchanger, and an outdoor expansion valve. The indoor unit includes an indoor expansion valve, an indoor heat exchanger, and a plurality of first sensors. The compressor, the four-way valve, the outdoor heat exchanger, the outdoor expansion valve, the indoor expansion valve, the indoor heat exchanger, and the compressor are sequentially connected, so as to provide a refrigerant circulation. The plurality of first sensors are configured to detect at least one of a temperature or a pressure of the refrigerant circulation, so as to make the controller determine a superheat degree of an outlet of the indoor heat exchanger and a heat exchange temperature difference of the indoor heat exchanger that are in a first cooling state. The first cooling state refers to a current cooling state of the indoor unit. The controller is configured to: in a case where the air conditioner is in a cooling state, determine an operating parameter of the indoor unit in a second cooling state according to a heat exchange area, a heat exchange coefficient, and the heat exchange temperature difference of the indoor heat exchanger; the second cooling state referring to a cooling state in which the superheat degree of the outlet of the indoor heat exchanger is substantially equal to a first preset value in the cooling state; the operating parameter of the indoor unit including a sensible heat load of the indoor unit in the cooling state; and determine an operating parameter of the indoor unit in the first cooling state according to the superheat degree of the outlet of the indoor heat exchanger in the first cooling state, the superheat degree of the outlet of the indoor heat exchanger in the second cooling state, and the operating parameter of the indoor unit in the second cooling state.

In another aspect, a method for calculating an operating parameter of an indoor unit is provided. The method is applied to an air conditioner. The air conditioner includes an outdoor unit and an indoor unit. The outdoor unit includes a compressor, a four-way valve, an outdoor heat exchanger, and an outdoor expansion valve. The indoor unit includes an indoor expansion valve, an indoor heat exchanger, and a plurality of first sensors. The compressor, the four-way valve, the outdoor heat exchanger, the outdoor expansion valve, the indoor expansion valve, the indoor heat exchanger, and the compressor are sequentially connected, so as to provide a refrigerant circulation. The plurality of first sensors are configured to detect at least one of a temperature or a pressure of the refrigerant circulation, so as to permit a controller to determine a superheat degree of an outlet of the indoor heat exchanger and a heat exchange temperature difference of the indoor heat exchanger that are in a first cooling state. The first cooling state refers to a current cooling state of the indoor unit. The method includes: in a case where the air conditioner is in a cooling state, determining an operating parameter of the indoor unit in a second cooling state according to a heat exchange area, a heat exchange coefficient, and the heat exchange temperature difference of the indoor heat exchanger; the second cooling state referring to a cooling state in which the superheat degree of the outlet of the indoor heat exchanger is substantially equal to a first preset value in the cooling state; the operating parameter of the indoor unit including a sensible heat load of the indoor unit in the cooling state; and determining an operating parameter of the indoor unit in the first cooling state according to the superheat degree of the outlet of the indoor heat exchanger in the first cooling state, the superheat degree of the outlet of the indoor heat exchanger in the second cooling state, and the operating parameter of the indoor unit in the second cooling state.

DETAILED DESCRIPTION

Figure 1:
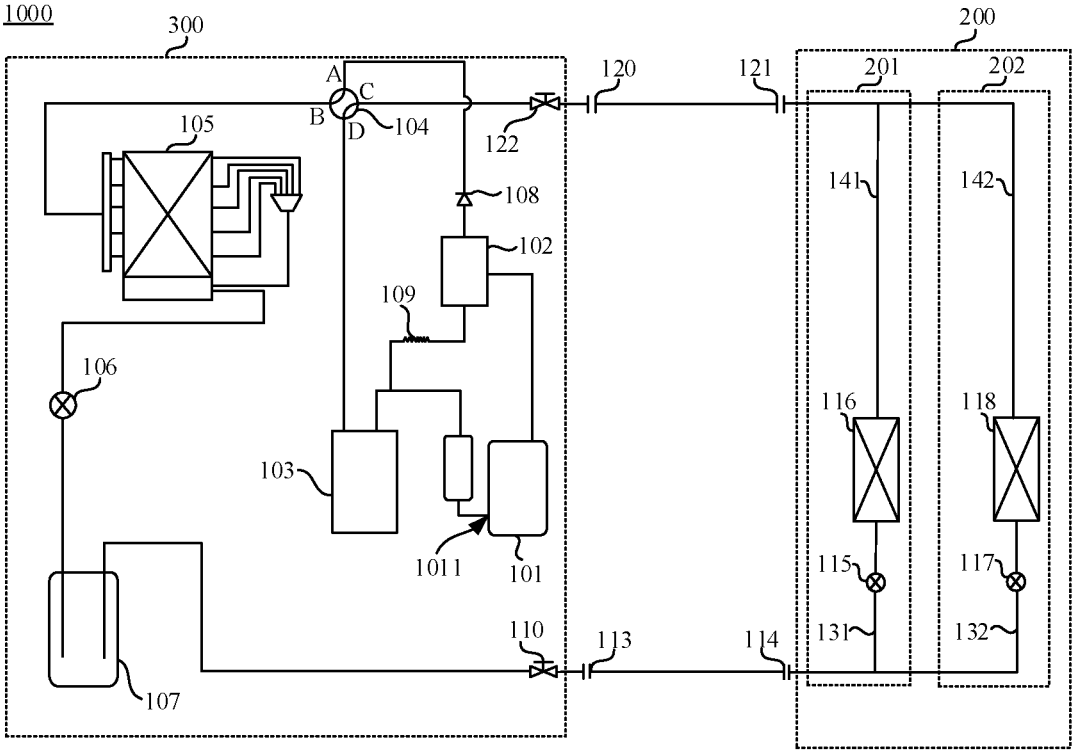
FIG. 1 is a diagram showing a structure of an air conditioner, in accordance with some embodiments.

Some embodiments of the present disclosure will be clearly and completely described below with reference to the accompanying drawings. However, the described embodiments are merely some but not all embodiments of the present disclosure. All other embodiments understood by a person of ordinary skill in the art based on embodiments of the present disclosure shall be included in the protection scope of the present disclosure.

Unless the context requires otherwise, throughout the specification and the claims, the term "comprise" and other forms thereof such as the third-person singular form "comprises" and the present participle form "comprising" are construed as an open and inclusive meaning, i.e., "including, but not limited thereto." In the description of the specification, the terms such as "one embodiment," "some embodiments," "exemplary embodiments," "example," "specific example," or "some examples" are intended to indicate that specific features, structures, materials, or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics may be included in any one or more embodiments or examples in any suitable manner.

In the description of the present disclosure, it will be understood that, orientations or positional relationships indicated by the terms such as "center," "upper," "lower," "front," "rear," "left," "right," "vertical," "horizontal," "top," "bottom," "inner," "outer," and the like are based on orientations or positional relationships shown in the drawings, which are merely to facilitate and simplify the description of the present disclosure, and are not to indicate or imply that the devices or elements referred to must have a particular orientation, or must be constructed or operated in a particular orientation. Therefore, these terms will not be construed as limitations on the present disclosure.

Hereinafter, the terms such as "first" and "second" are used for descriptive purposes only and are not to be construed as indicating or implying the relative importance or implicitly indicating the number of indicated technical features. Thus, features defined by "first" or "second" may explicitly or implicitly include one or more of the features. In the description of the embodiments of the present disclosure, the term "a plurality of" or "the plurality of" means two or more unless otherwise specified.

In the description of some embodiments, it will be noted that, unless otherwise explicitly stated and limited, the terms "installation," "connection," and "connect" should be understood in a broad sense. For example, the terms "installation," "connection," and "connect" may represent a fixed connection, a detachable connection, or a one-piece connection; or may represent a mechanical connection, or an electrical connection; or may represent a direct connection, an indirect connection through an intermediate medium, or a connection that two components are internally communicated with each. Specific meanings of the above terms in the present disclosure may be understood by those skilled in the art according to specific situations.

The phrase "at least one of A, B, and C" has the same meaning as the phrase "at least one of A, B, or C," both including the following combinations of A, B, and C: only A, only B, only C, a combination of A and B, a combination of A and C, a combination of B and C, and a combination of A, B, and C.

As used herein, the term "if" is, optionally, construed as "when" or "in a case where" or "in response to determining that" or "in response to detecting," depending on the context. Similarly, depending on the context, the phrase "if it is determined that" or "if [a stated condition or event] is detected" is optionally construed as "in a case where it is determined that" or "in response to determining that" or "in a case where [the stated condition or event] is detected" or "in response to detecting [the stated condition or event]."

The use of the phrase "applicable to" or "configured to" herein means an open and inclusive expression, which does not exclude devices that are applicable to or configured to perform additional tasks or steps.

Generally, in an air conditioner, the indoor unit and the outdoor unit each are provided with a plurality of sensors. The operating parameter of the indoor unit is calculated by performing a complex calculation on the values detected by the plurality of sensors. However, the complex calculation increases the operating load of a controller in the air conditioner. Moreover, in a case where the components in the air conditioner are damaged or aged, the data detected by the sensors may not accurately reflect the actual state of the air conditioner. Therefore, the calculated operating parameter of the indoor unit is not accurate and has large errors.

FIG. 1 is a diagram showing a structure of an air conditioner, in accordance with some embodiments. In order to solve the above problem, as shown in FIG. 1, in some embodiments of the present disclosure, an air conditioner 1000 is provided. The air conditioner 1000 includes an outdoor unit 300 and one or more indoor units 200. Components in the indoor unit 200 and components in the outdoor unit 300 are connected to each other by means of pipelines, so as to form a refrigerant circulation to transport refrigerant. When circulating in the circulation flow path, the refrigerant exchanges heat with the air through the heat exchangers (e.g., a condenser and an evaporator), so as to achieve cooling or heating.

The outdoor unit 300 may include a compressor 101, an oil separator 102, a four-way valve 104, an outdoor heat exchanger 105, an outdoor expansion valve 106, and a liquid storage device 107 that are connected in sequence by means of pipelines.

The indoor unit 200 includes an indoor liquid pipe, an indoor expansion valve, an indoor heat exchanger, and an indoor gaseous pipe connected in sequence by means of pipelines. Two indoor units 200 including a first indoor unit 201 and a second indoor unit 202 are shown in FIG. 1. The first indoor unit 201 may include a first indoor liquid pipe 131, a first indoor expansion valve 115, a first indoor heat exchanger 116, and a first indoor gaseous pipe 141 connected in sequence by means of pipelines. The second indoor unit 202 may include a second indoor liquid pipe 132, a second indoor expansion valve 117, a second indoor heat exchanger 118, and a second indoor gaseous pipe 142 connected in sequence by means of pipelines.

The first indoor gaseous pipe 141 and the second indoor gaseous pipe 142 are connected to the four-way valve 104.

The first indoor liquid pipe 131 and the second indoor liquid pipe 132 are connected to the outdoor expansion valve 106 through the liquid storage device 107, so that the outdoor unit 300 may form a refrigerant circulation with one or more indoor units 200. For example, the indoor unit 200 is communicated with the outdoor unit 300 through a third joint 120, a fourth joint 121, a first joint 113, and a second joint 114, so as to form the refrigerant circulation.

The outdoor unit 300 may communicate with the liquid pipes (e.g., the first indoor liquid pipe 131 and the second indoor liquid pipe 132) of the indoor units 200 through the first joint 113 and the second joint 114, and the outdoor unit 300 may communicate with the gaseous pipes (e.g., the first indoor gaseous pipe 141 and the second indoor gaseous pipe 142) of the indoor units 200 through the third joint 120 and the fourth joint 121.

In addition, the outdoor unit 300 further includes a gas-liquid separator 103. An air inlet 1011 of the compressor 101 is connected to a port of the four-way valve 104 through the gas-liquid separator 103, so that the superheated gaseous refrigerant with low temperature and low pressure after heat exchange in the evaporator may return to the compressor 101. It will be noted that the gaseous pipe refers to a pipeline located on a side of the indoor heat exchanger proximate to the compressor 101, and the refrigerant in the pipeline may be in a gaseous state. The liquid pipe refers to a pipeline located on a side of the indoor heat exchanger away from the compressor 101, and the refrigerant in the pipeline may be in a liquid state.

The compressor 101 is configured to compress a gaseous refrigerant, so that the gaseous refrigerant with low temperature and low pressure may be compressed to be a gaseous refrigerant with high temperature and high pressure. The gaseous refrigerant with high temperature and high pressure compressed by the compressor 101 may be transported to the condenser through the four-way valve 104. The gaseous refrigerant with high temperature and high pressure condenses in the condenser and becomes a supercooled liquid refrigerant with medium or high temperature and high pressure. The liquid refrigerant with medium or high temperature and high pressure is then throttled by the expansion valve and becomes a gas-liquid two-phase refrigerant with low temperature and low pressure.

The gas-liquid two-phase refrigerant with low temperature and low pressure is transported to the evaporator. The evaporator is configured to convert the gas-liquid two-phase refrigerant with low temperature and low pressure into the superheated gaseous refrigerant with low temperature and low pressure by exchanging heat with the air. Then, the superheated gaseous refrigerant with low temperature and low pressure may return to the air inlet 1011 of the compressor 101 through the gas-liquid separator 103, thereby completing a cooling cycle or a heating cycle.

It will be noted that, in a cooling state, the outdoor heat exchanger 105 serves as a condenser, and the first indoor heat exchanger 116 and the second indoor heat exchanger 118 serve as evaporators. In a heating state, the outdoor heat exchanger 105 serves as an evaporator, and the first indoor heat exchanger 116 and the second indoor heat exchanger 118 serve as condensers.

In addition, the outdoor expansion valve 106, the first indoor expansion valve 115, and the second indoor expansion valve 117 may be electronic expansion valves, and each have a function of expanding the refrigerant flowing through the expansion valve and reducing a pressure of the refrigerant flowing through the expansion valve and are configured to regulate a flow rate of the refrigerant in the pipe. If an opening degree of the electronic expansion valve is decreased, resistance of the refrigerant passing through the electronic expansion valve is increased. If the opening degree of the electronic expansion valve is increased, resistance of the refrigerant passing through the electronic expansion valve is decreased.

In this way, even if the states of other components in the refrigerant circulation remain unchanged, when the opening degree of the electronic expansion valve is changed, the flow rate of the refrigerant will also be changed. In this way, the flow rate of the refrigerant entering into the heat exchanger (e.g., the outdoor heat exchanger 105, the first indoor heat exchanger 116 or the second indoor heat exchanger 118) may be adjusted by regulating the opening degree of the electronic expansion valve, so that the heat exchange efficiency of the heat exchanger may be adjusted to regulate the operating power consumption of the air conditioner 1000.

It will be noted that some embodiments of the present disclosure do not limit the pressures or pressure ranges of the refrigerant with high pressure, medium pressure, or low pressure described above. It can be understood that the high pressure, the medium pressure, and the low pressure are used to describe the relative high pressure and relative low pressure of the refrigerant at different periods or when the refrigerant flows to different positions in the refrigerant circulation. That is to say, the pressure of the refrigerant with high pressure is greater than that of the refrigerant with medium pressure, and the pressure of the refrigerant with medium pressure is greater than that of the refrigerant with low pressure.

Similarly, some embodiments of the present disclosure do not limit the temperatures or temperature ranges of the refrigerant with high temperature, medium temperature, or low temperature described above. It can be understood that the high temperature, the medium temperature, and the low temperature are used to describe the relative high temperature and relative low temperature of the refrigerant at different periods or when the refrigerant flows to different positions in the refrigerant circulation. That is to say, the temperature of the refrigerant with high temperature is greater than that of the refrigerant with medium temperature, and the temperature of the refrigerant with medium temperature is greater than that of the refrigerant with low temperature.

The operating principles of the cooling state and the heating state of the air conditioner 1000 provided by some embodiments of the present disclosure will be described below with reference to FIGS. 2 and 3.

Figure 2:
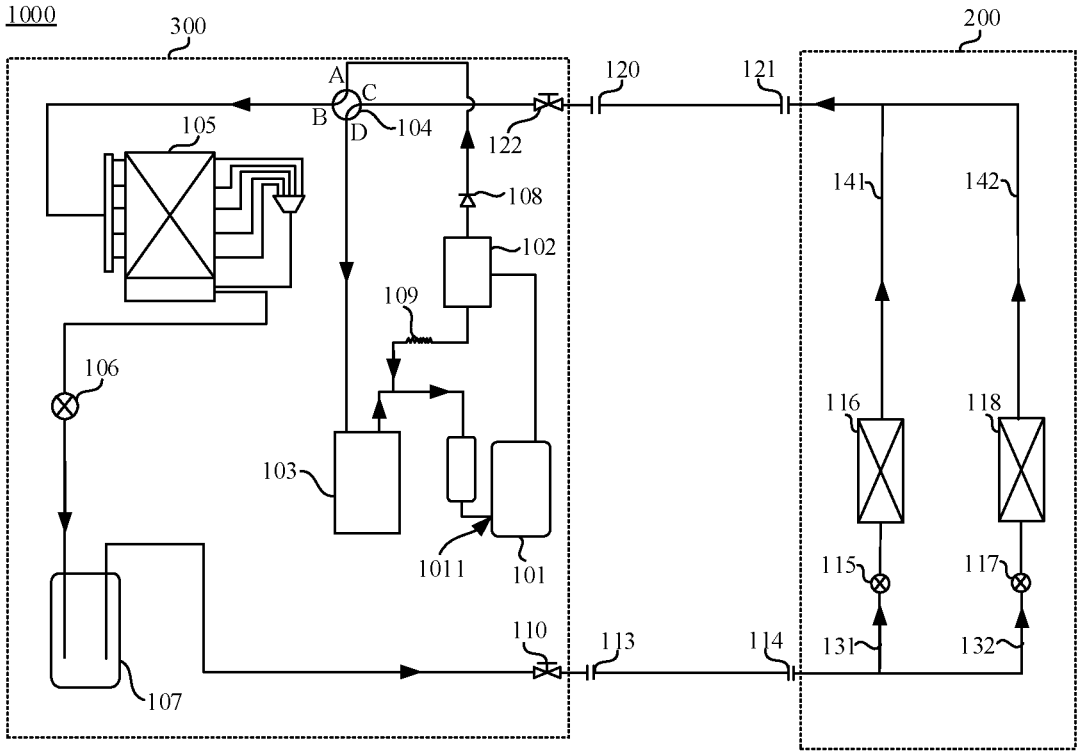
FIG. 2 is a diagram showing a principle of a cooling state of an air conditioner, in accordance with some embodiments.

In a case where the air conditioner 1000 is in the cooling state, as shown in FIG. 2, the gaseous refrigerant with high temperature and high pressure discharged from the operating compressor 101 enters the oil separator 102. When the compressor 101 compresses the gaseous refrigerant, part of engine oil is easily discharged from the compressor 101 together with the gaseous refrigerant due to the presence of engine oil on a wall of a cylinder in the compressor 101. However, the liquid engine oil and the gaseous refrigerant may be separated after the gaseous refrigerant with high temperature and high pressure passes through the oil separator 102. The liquid engine oil returns to the air inlet 1011 of the compressor 101 through a regulator 109.

Figure 4:
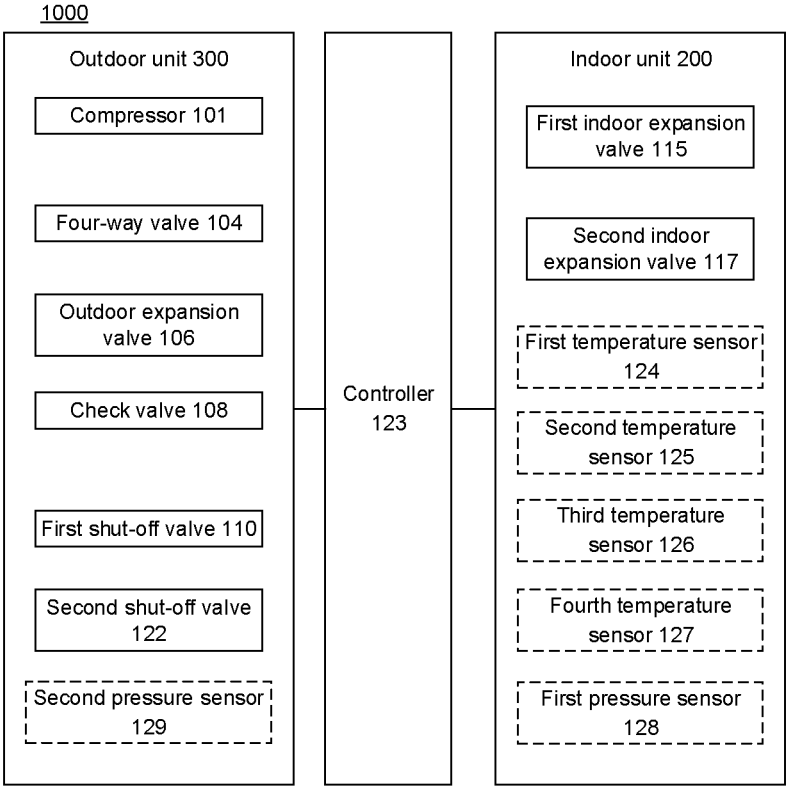
FIG. 4 is a block diagram of an air conditioner, in accordance with some embodiments.

In this case, a first port A of the four-way valve 104 is communicated with a second port B of the four-way valve 104, and the gaseous refrigerant enters the outdoor heat exchanger 105 after passing through a check valve 108 and the four-way valve 104 in sequence. The gaseous refrigerant becomes a supercooled liquid refrigerant with high temperature and high pressure after exchanging heat sufficiently in the outdoor heat exchanger 105. A controller 123 (as shown in FIG. 4) controls the outdoor expansion valve 106 to be fully opened, and the supercooled liquid refrigerant enters the liquid storage device 107 through the outdoor expansion valve 106. The supercooled liquid refrigerant in the liquid storage device 107 then enters the first indoor liquid pipe 131 and the second indoor liquid pipe 132 through a first shut-off valve 110.

In a case where the air conditioner 1000 includes two indoor units 200, the supercooled liquid refrigerant enters the two indoor units 200 in two separate paths. Here, one channel of supercooled liquid refrigerant is throttled by the first indoor expansion valve 115 into a gas-liquid two-phase refrigerant with low temperature and low pressure and enters the first indoor heat exchanger 116; and another channel of supercooled liquid refrigerant is throttled by the second indoor expansion valve 117 into a gas-liquid two-phase refrigerant with low temperature and low pressure and enters the second indoor heat exchanger 118. The gas-liquid two-phase refrigerant evaporates and becomes a superheated gaseous refrigerant with low temperature and low pressure in the first indoor heat exchanger 116 and the second indoor heat exchanger 118.

The superheated gaseous refrigerant with low temperature and low pressure flows out from the first indoor heat exchanger 116 and the second indoor heat exchanger 118 and passes through the first indoor gaseous pipe 141 and the second indoor gaseous pipe 142. In addition, the controller 123 further controls a third port C of the four-way valve 104 to be communicated with a fourth port D of the four-way valve 104, and the superheated gaseous refrigerant with low temperature and low pressure passing through the second shut-off valve 122 passes through the four-way valve 104 and enters the gas-liquid separator 103. After the gas-liquid separator 103 performs gas-liquid separation on the refrigerant, the refrigerant in the gas-liquid separator 103 is divided into a gaseous refrigerant and a liquid refrigerant, and the gaseous refrigerant flows into the air inlet 1011 of the compressor 101, thereby completing the cooling cycle.

Figure 3:
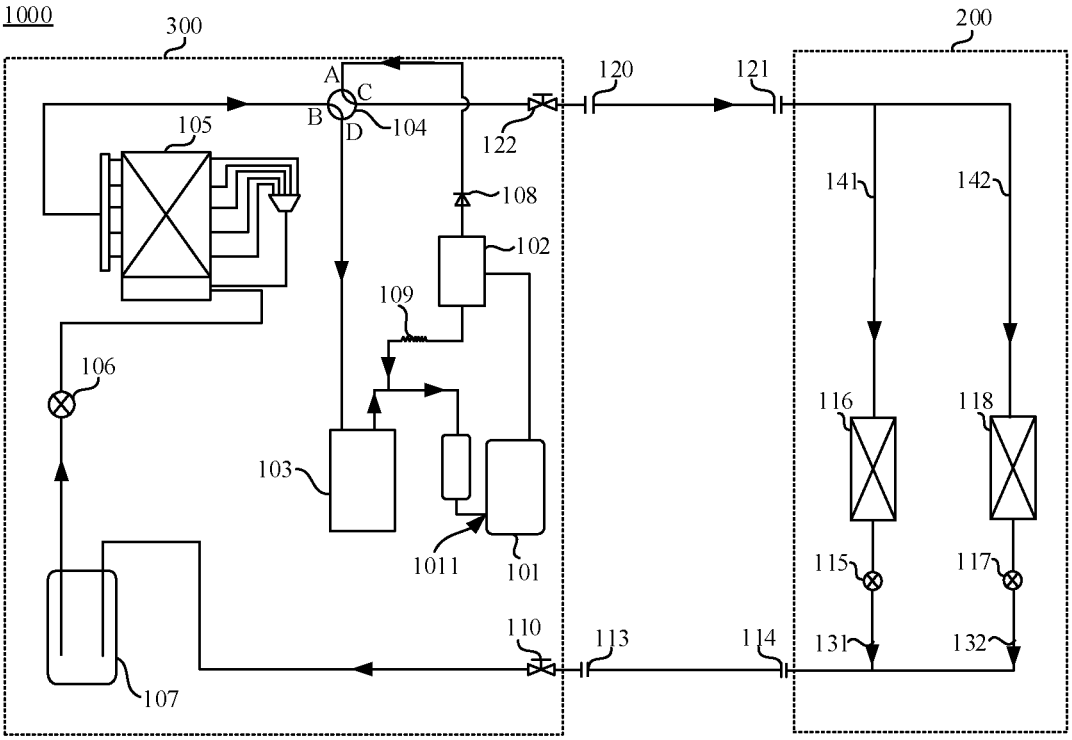
FIG. 3 is a diagram showing a principle of a heating state of an air conditioner, in accordance with some embodiments.

In a case where the air conditioner 1000 is in the heating state, as shown in FIG. 3, the first port A of the four-way valve 104 is communicated with the third port C of the four-way valve 104, and the second port B of the four-way valve 104 is communicated with the fourth port D of the four-way valve 104. The superheated gaseous refrigerant with high temperature and high pressure discharged from the compressor 101 may pass through the oil separator 102, the check valve 108, the four-way valve 104, and the second shut-off valve 122 in sequence and enter the first indoor gaseous pipe 141 and the second indoor gaseous pipe 142, so as to enter the two indoor units 200.

The two channels of superheated gaseous refrigerant condense and become the supercooled liquid refrigerant with medium temperature and high pressure in the first indoor heat exchanger 116 and the second indoor heat exchanger 118, respectively, and enter the first indoor liquid pipe 131 and the second indoor liquid pipe 132 through the first indoor expansion valve 115 and the second indoor expansion valve 117, respectively. Then, the two channels of supercooled liquid refrigerant with medium temperature and high pressure enter into the liquid storage device 107 through the first shut-off valve 110 and are converted into a gas-liquid two-phase refrigerant with medium temperature and low pressure through the throttling and depressurization of the outdoor expansion valve 106. The gas-liquid two-phase refrigerant with medium temperature and low pressure flows into the air inlet 1011 of the compressor 101 after passing through the outdoor heat exchanger 105, the four-way valve 104, and the gas-liquid separator 103 in sequence, thereby completing the heating cycle.

In some embodiments, the outdoor unit 300 may further include an outdoor fan and a first motor. The outdoor fan is configured to draw an outdoor air into the outdoor unit 300 through an outdoor air inlet of the outdoor unit 300 and exhaust the outdoor air after the outdoor air exchanges heat in the outdoor heat exchanger 105 through an outdoor air outlet of the outdoor unit 300. The outdoor fan provides power for the flow of the outdoor air. The first motor is configured to drive or change a rotation speed of the outdoor fan, so as to adjust the wind force of the outdoor fan. Similarly, the indoor unit 200 may further include an indoor fan and a second motor.

In some embodiments, the indoor unit 200 may further include a display configured to display an indoor temperature or a current operating mode, so that the user may easily know the current state of the air conditioner 1000, such as whether the air conditioner 1000 is in the heating state or the cooling state.

In some embodiments, as shown in FIG. 4, the air conditioner 1000 further includes a controller 123. The controller 123 is coupled to devices (e.g., the compressor 101, the four-way valve 104, the first motor, the outdoor expansion valve 106, the second motor, the first indoor expansion valve 115, and the second indoor expansion valve 117) through communication lines and communication interfaces and configured to adjust the state of the air conditioner 1000 according to the instruction of the user and the preset configuration of the system.

Figure 5:
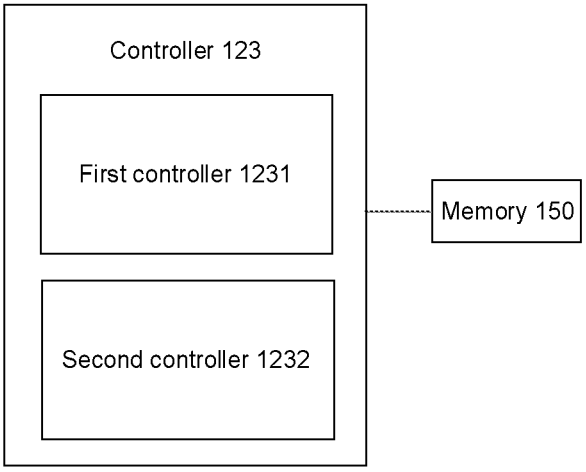
FIG. 5 is a block diagram of a controller, in accordance with some embodiments.

It will be noted that, in some embodiments of the present disclosure, the controller 123 may be an integrated control device, which may be used to control devices in the indoor unit 200 and the outdoor unit 300. Of course, the controller 123 may also include a plurality of independent control devices. As shown in FIG. 5, the controller 123 includes a first controller 1231 and a second controller 1232.

The second controller 1232 is communicatively connected to the first controller 1231 in a wired or wireless manner. The first controller 1231 may be installed in or independent from the outdoor unit 300 and configured to control the devices in the outdoor unit 300 to perform relevant operations. The second controller 1232 may be installed in or independent from the indoor unit 200 and configured to control the devices in the indoor unit 200 to perform relevant operations.

The controller 123 refers to a device that may generate an operation control signal to instruct the air conditioner 1000 to execute a control instruction according to an operation code and a timing signal. For example, the controller 123 includes a central processing unit (CPU), a digital signal processing (DSP), or any combination thereof. The controller 123 may also be other devices with processing functions, such as circuits, devices or software, and the present disclosure is not limited thereto. Here, the operation code refers to a part of instructions or fields (e.g., codes) specified in the computer program to perform a corresponding operation.

Figure 6:
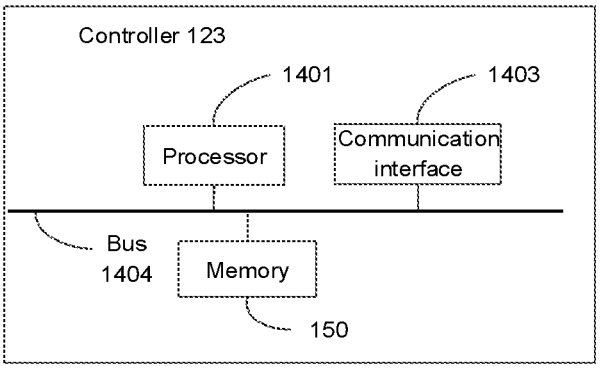
FIG. 6 is a block diagram of another controller, in accordance with some embodiments.

In some embodiments, as shown in FIG. 6, the controller 123 includes a processor 1401, a memory 150, and a communication interface 1403 that are connected by means of a bus 1404.

The processor 1401 may refer to one or more devices, circuits, or processing cores for processing data (e.g., computer program instructions).

The memory 150 is configured to store relevant application programs and data of the outdoor unit 300 and the indoor unit 200. By performing the application programs and data stored in the memory 150, it is possible to perform data processing to achieve functions of the air conditioner 1000.

The memory 150 may include a program storage region and a data storage region. The program storage region is configured to store application programs (e.g., a function of starting the outdoor fan and a function of detecting an outdoor temperature) required by the operating system and functions. The data storage region is configured to store data (e.g., the outdoor temperature and the opening degrees of electronic expansion valves). The memory 150 may include a random access memory (RAM) or a non-volatile memory (NVM).

In some embodiments, the memory 150 is further configured to store a corresponding relationship between an address of the indoor unit 200 and an address of the electronic expansion valve.

The communication interface 1403 may be used to communicate with other devices or communication networks (e.g., Ethernet, radio access networks (RANs), wireless local area networks (WLANs)). The communication interface 1403 may be a module, a circuit, a transceiver, or any device capable of achieving communication.

The bus 1404 may include a peripheral component interconnect (PCI) bus or an extended industry standard architecture (EISA) bus, or the like. The bus 1404 may be divided into an address bus, a data bus, a control bus, etc. For convenience of illustration, one thick line is used to represent the bus in FIG. 6, but it does not mean that there is only one bus or one type of bus.

In some embodiments, the memory 150 may also be independent from the controller 123. For example, as shown in FIG. 5, the air conditioner 1000 includes a memory 150 communicatively connected to the controller 123.

In some embodiments, the air conditioner 1000 further includes a remote control device. The remote control device, for example, has a function of communicating with the controller 123 by using infrared or other communication manners. The users may perform various controls on the air conditioner 1000 by using the remote control device, so that interaction between the users and the air conditioner 1000 may be achieved. For example, the remote control device includes a remote controller or a mobile terminal.

The air conditioner 1000 provided by some embodiments of the present disclosure may also calculate an operating parameter of the indoor unit 200 in the current state. Here, the operating parameter of the indoor unit 200 includes a sensible heat load (may also be referred to as a cooling sensible heat) of the indoor unit 200 in the cooling state or a sensible heat load (may also be referred to as heating sensible heat) of the indoor unit 200 in the heating state. The calculated operating parameter of the indoor unit 200 in the current state may be used as a parameter index for adjusting the air conditioner 1000, so that the cooling or heating effect of the air conditioner 1000 may be improved and the power consumption may be reduced.

It will be noted that sensible heat refers to the heat absorbed or released when the temperature of an object increases or decreases and an original phase state of the object remains unchanged during the heating or cooling process of an object.

Therefore, in some embodiments, the controller 123 is configured to determine an operating parameter of the indoor unit 200 in a second cooling state according to a heat exchange area, a heat exchange coefficient, and a heat exchange temperature difference of an indoor heat exchanger (e.g., the evaporator), in a case where the indoor unit 200 is in the cooling state; and determine an operating parameter of the indoor unit 200 in a first cooling state according to a superheat degree of an outlet of the indoor heat exchanger in the first cooling state, a superheat degree of the outlet of the indoor heat exchanger in the second cooling state, and the operating parameter of the indoor unit 200 in the second cooling state.

It will be noted that the first cooling state refers to the current cooling state of the indoor unit 200. The second cooling state refers to a cooling state in which the superheat degree of the outlet of the indoor heat exchanger of the indoor unit 200 is substantially equal to a first preset value (e.g., 5° C. or 3.5° C.) in the cooling state. The operating parameter of the indoor unit 200 includes the sensible heat load of the indoor unit 200 in the cooling state.

In some embodiments, the controller 123 is further configured to determine an operating parameter of the indoor unit 200 in a second heating state according to the heat exchange area, the heat exchange coefficient, and the heat exchange temperature difference of the indoor heat exchanger (e.g., the condenser) in a case where the air conditioner 1000 is in the heating state; and determine an operating parameter of the indoor unit 200 in a first heating state according to a superheat degree of an inlet of the indoor heat exchanger in the first heating state, a supercooling degree of an outlet of the indoor heat exchanger in the first heating state, a superheat degree of the inlet of the indoor heat exchanger in the second heating state, a supercooling degree of the outlet of the indoor heat exchanger in the second heating state, and the operating parameter of the indoor unit 200 in the second heating state.

It will be noted that, the first heating state refers to the current heating state of the indoor unit 200. The second heating state refers to a heating state in which the superheat degree of the inlet of the indoor heat exchanger of the indoor unit 200 is substantially equal to a second preset value (e.g., 30° C. or 27° C.), and the supercooling degree of the outlet of the indoor heat exchanger is substantially equal to a third preset value (e.g., 15° C. or 12° C.) in the heating state. The operating parameter of the indoor unit 200 includes the sensible heat load of the indoor unit 200 in the heating state.

The heat exchange temperature difference, the superheat degree of the outlet of the evaporator, the superheat degree of the inlet of the condenser, and the supercooling degree of the outlet of the condenser may be obtained through values collected by sensors disposed in the air conditioner 1000. The heat exchange temperature difference is a corresponding heat exchange temperature difference in the current cooling state or the current heating state (i.e., the first cooling state or the first heating state).

In some embodiments, one indoor unit 200 may further include a plurality of first sensors. Arrangement positions of the plurality of sensors will be described below with reference to FIGS. 7 to 10.

Figure 7:
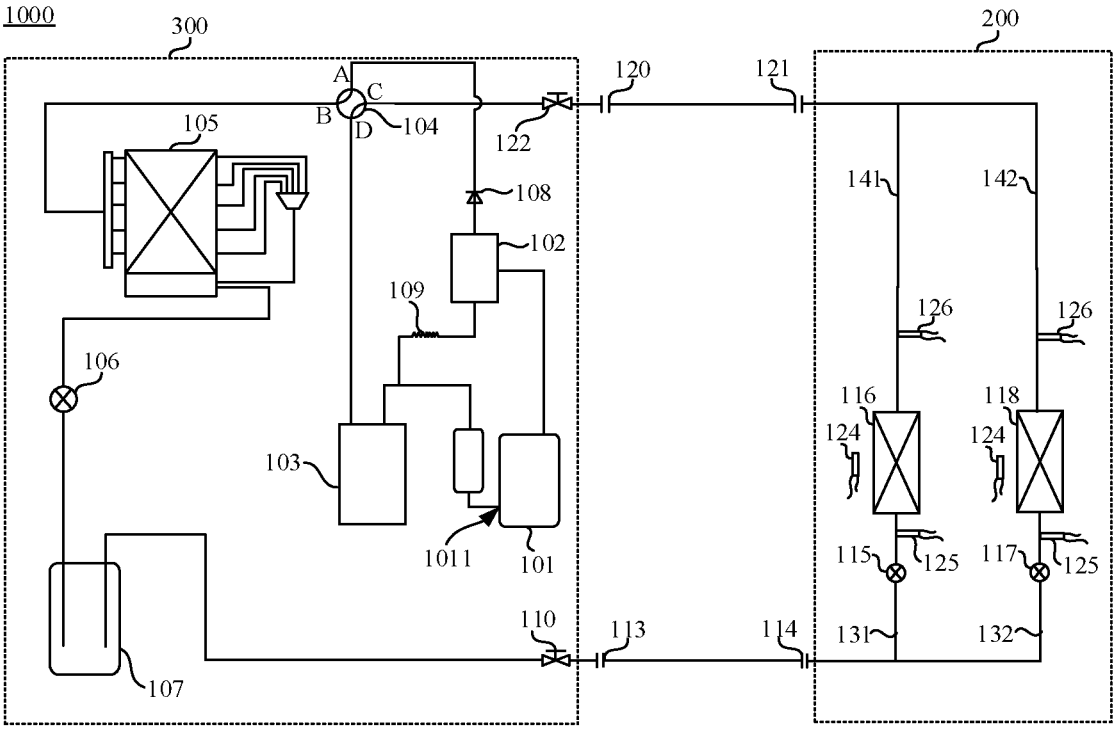
FIG. 7 is a diagram showing a structure of another air conditioner, in accordance with some embodiments.

In some examples, as shown in FIG. 7, the plurality of first sensors include a first temperature sensor 124, a second temperature sensor 125, and a third temperature sensor 126.

The first temperature sensor 124 is disposed at an air inlet of the indoor heat exchanger. For example, in a case where the air conditioner 1000 includes two indoor units 200, the plurality of first sensors further include two first temperature sensor 124 disposed on air inlets of the first indoor heat exchanger 116 and the second indoor heat exchanger 118, respectively, and configured to detect temperatures of the air inlets of the indoor units 200.

The second temperature sensor 125 is disposed on the indoor liquid pipe. For example, in a case where the air conditioner 1000 includes two indoor units 200, the plurality of first sensors further include two second temperature sensors 125 disposed on the first indoor liquid pipe 131 and the second indoor liquid pipe 132, respectively, and configured to detect the temperatures of the first indoor liquid pipe 131 and the second indoor liquid pipe 132.

The third temperature sensor 126 is disposed on the indoor gaseous pipe. For example, in a case where the air conditioner 1000 includes two indoor units 200, the plurality of first sensors further include two third temperature sensors 126 disposed on the first indoor gaseous pipe 141 and the second indoor gaseous pipe 142, respectively, and configured to detect the temperatures of the first indoor gaseous pipe 141 and the second indoor gaseous pipe 142.

In this case, considering the first indoor unit 201 as an example, the controller 123 may be configured to determine a heat exchange temperature difference of the first indoor heat exchanger 116 according to the temperature of the air inlet of the first indoor heat exchanger 116 (i.e., the evaporator) detected by the first temperature sensor 124 and the temperature (i.e., the temperature of the inlet of the evaporator) of the first indoor liquid pipe 131 detected by the second temperature sensor 125, in a case where the air conditioner 1000 is in the cooling state.

Moreover, the controller 123 may also be configured to calculate a superheat degree of the outlet of the first indoor heat exchanger 116 according to the temperature of the first indoor liquid pipe 131 detected by the second temperature sensor 125 and the temperature of the first indoor gaseous pipe 141 detected by the third temperature sensor 126, in a case where the air conditioner 1000 is in the cooling state.

Figure 8:
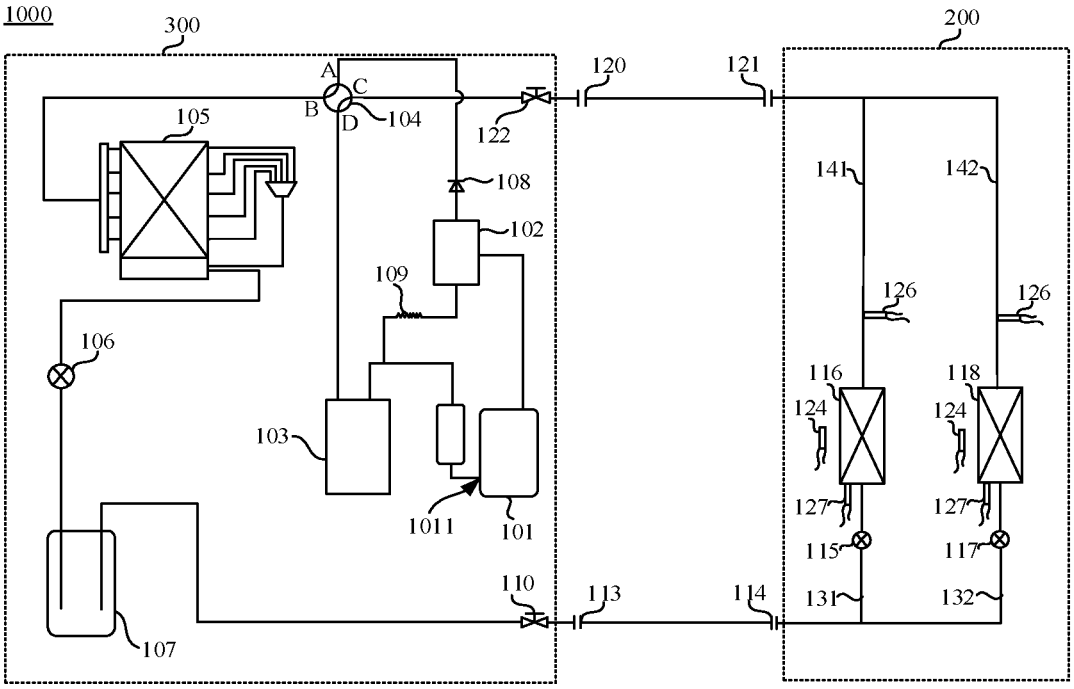
FIG. 8 is a diagram showing a structure of yet another air conditioner, in accordance with some embodiments.

In some other examples, as shown in FIG. 8, the plurality of first sensors include the first temperature sensor 124, the third temperature sensor 126, and a fourth temperature sensor 127. Compared with FIG. 7, in the plurality of first sensors shown in FIG. 8, the second temperature sensor 125 is replaced by the fourth temperature sensor 127. The fourth temperature sensor 127 is disposed on a coil (e.g., a bend) of the indoor heat exchanger (e.g., the first indoor heat exchanger 116 and the second indoor heat exchanger 118) and configured to detect the temperature of the coil of the indoor heat exchanger.

In this case, considering the first indoor unit 201 as an example, the controller 123 may be configured to calculate the heat exchange temperature difference of the first indoor heat exchanger 116 according the temperature of the air inlet of the first indoor heat exchanger 116 detected by the first temperature sensor 124 and the temperature of the coil of the first indoor heat exchanger 116 detected by the fourth temperature sensor 127, in a case where the air conditioner 1000 is in the cooling state.

Moreover, the controller 123 may also be configured to calculate the superheat degree of the outlet of the first indoor heat exchanger 116 according to the temperature of the first indoor gaseous pipe 141 detected by the third temperature sensor 126 and the temperature of the coil of the first indoor heat exchanger 116 detected by the fourth temperature sensor 127, in a case where the air conditioner 1000 is in the cooling state.

Figure 9:
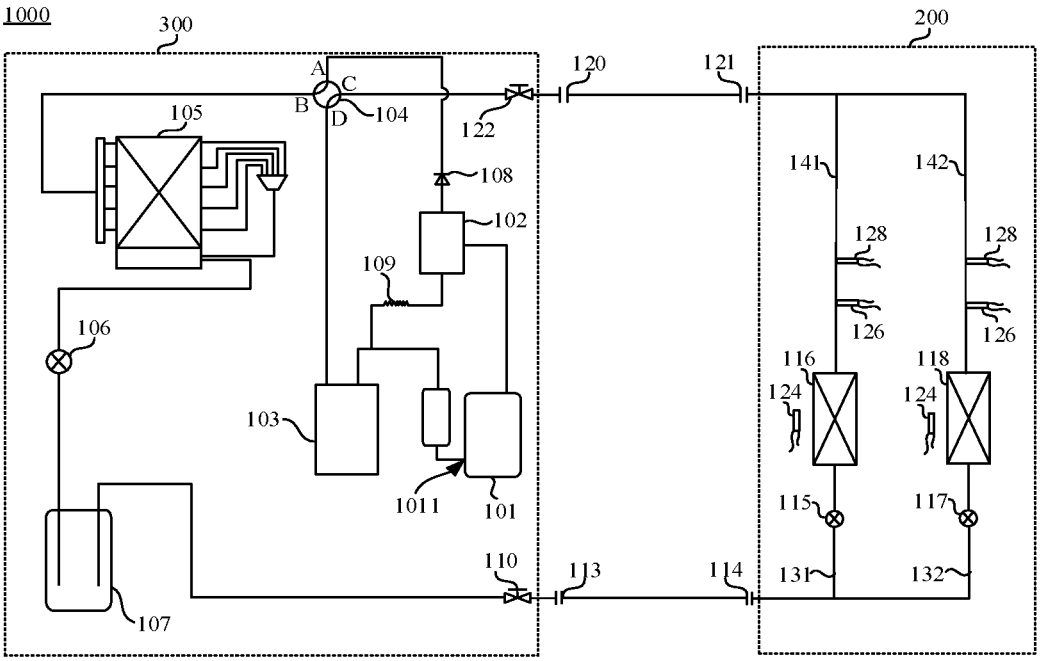
FIG. 9 is a diagram showing a structure of yet another air conditioner, in accordance with some embodiments.

In yet some other examples, as shown in FIG. 9, the plurality of first sensors include a first pressure sensor 128, the first temperature sensor 124, and the third temperature sensor 126. Compared with FIG. 7, in the plurality of first sensors shown in FIG. 9, the second temperature sensor 125 is replaced by the first pressure sensor 128.

The first pressure sensor 128 is disposed at the outlet of the indoor heat exchanger (e.g., the first indoor heat exchanger 116 and the second indoor heat exchanger 118) and configured to detect a pressure of the outlet (e.g., the indoor gaseous pipe) of the indoor heat exchanger, so as to obtain a first saturation temperature corresponding to the pressure of the outlet of the indoor heat exchanger.

In this case, considering the first indoor unit 201 as an example, the controller 123 may be configured to determine the heat exchange temperature difference of the first indoor heat exchanger 116 according to the temperature of the air inlet of the first indoor heat exchanger 116 detected by the first temperature sensor 124 and the first saturation temperature obtained through the first pressure sensor 128, in a case where the air conditioner 1000 is in the cooling state.

Moreover, the controller 123 may also be configured to calculate the superheat degree of the outlet of the first indoor heat exchanger 116 according to the temperature of the first indoor gaseous pipe 141 detected by the third temperature sensor 126 and the first saturation temperature obtained through the first pressure sensor 128, in a case where the air conditioner 1000 is in the cooling state.

Figure 10:
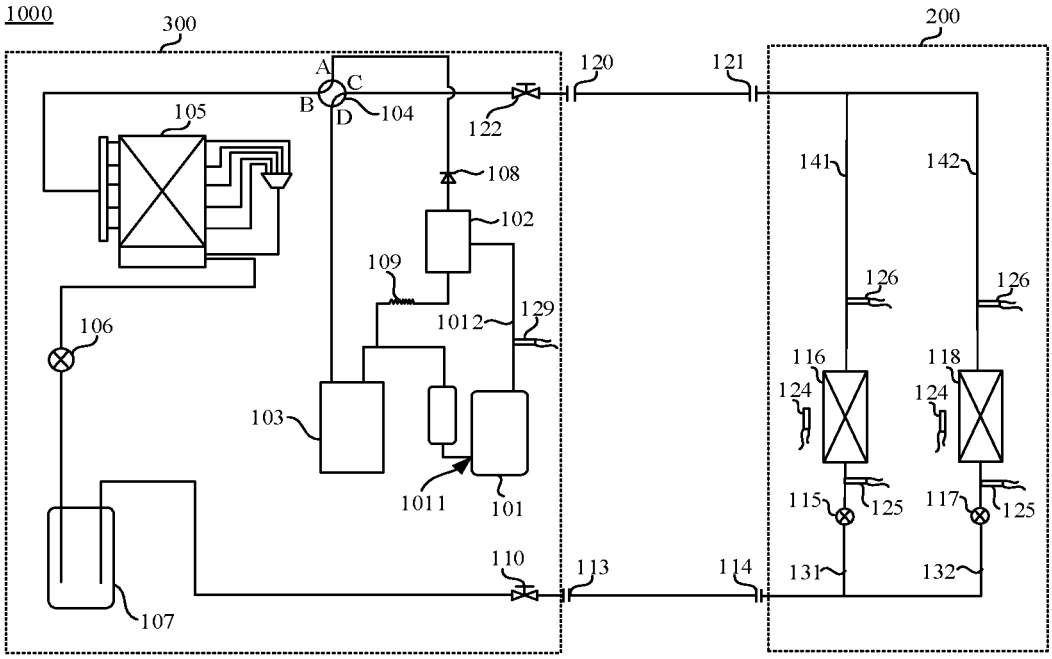
FIG. 10 is a diagram showing a structure of yet another air conditioner, in accordance with some embodiments.

In yet some other examples, as shown in FIG. 10, the plurality of first sensors include the first temperature sensor 124, the second temperature sensor 125, and the third temperature sensor 126. In addition, the outdoor unit 200 may further include one or more second sensors, and the one or more second sensors may include a second pressure sensor 129. Compared with FIG. 7, the second pressure sensor 129 is added in FIG. 10. The second pressure sensor 129 is disposed on an exhaust pipe 1012 of the compressor 101 and configured to detect a pressure of the exhaust pipe 1012 of the compressor 101, so as to obtain a second saturation temperature corresponding to the pressure of the exhaust pipe 1012 of the compressor 101. For example, the second pressure sensor 129 is located on an outer surface of the exhaust pipe 1012.

In this case, considering the first indoor unit 201 as an example, the controller 123 may be configured to calculate the heat exchange temperature difference of the first indoor heat exchanger 116 according to the temperature of the air inlet of the first indoor heat exchanger detected by the first temperature sensor 124 and the second saturation temperature obtained through the second pressure sensor 129, in a case where the air conditioner 1000 is in the heating state.

Moreover, the controller 123 may also be configured to calculate a superheat degree of an inlet of the first indoor heat exchanger 116 (i.e., the condenser) according to the temperature of the first indoor gaseous pipe 141 detected by the third temperature sensor 126 and the second saturation temperature obtained through the second pressure sensor 129, and calculate a supercooling degree of an outlet of the first indoor heat exchanger 116 according to the temperature of the first indoor liquid pipe 131 detected by the second temperature sensor 125 and the second saturation temperature, in a case where the air conditioner 1000 is in the heating state.

In the air conditioner 1000 provided by some embodiments of the present disclosure, the operating parameter of the indoor unit 200 in the current state (e.g., the first cooling state or the first heating state) is calculated according to the standard state (e.g., the second cooling state or the second heating state), so that the accurate operating parameter of the indoor unit 200 in the current state may be obtained. Moreover, since the plurality of corresponding relationships in the standard state are preset, the calculation process is simple and is conducive to reducing the operating load of the controller 123 in the air conditioner 1000. In addition, fewer parameters are used in the calculation process, which is conducive to reducing the number of sensors in the air conditioner 1000 and lowering the manufacturing cost of the air conditioner 1000.

Figure 11:
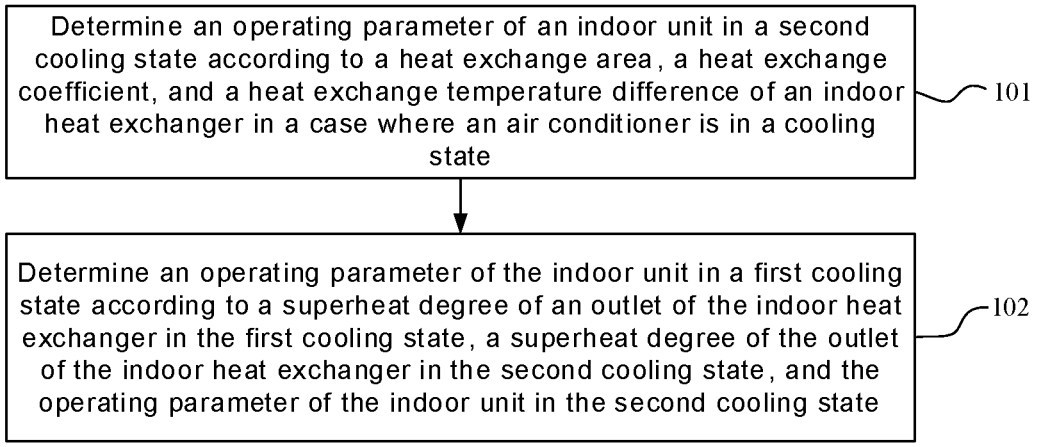
FIG. 11 is a flow chart of a method for calculating an operating parameter of an indoor unit, in accordance with some embodiments.

In some embodiments of the present disclosure, a method for calculating an operating parameter of an indoor unit is also provided, and the method is applied to the air conditioner 1000. FIG. 11 is a flow chart of a method for calculating an operating parameter of an indoor unit, in accordance with some embodiments. As shown in FIG. 11, the method may be performed by the controller 123 in the air conditioner 1000 shown in FIG. 4, and the method includes step 101 and step 102.

In step 101, in a case where the air conditioner 1000 is in a cooling state, an operating parameter of the indoor unit 200 in a second cooling state is determined according to a heat exchange area, a heat exchange coefficient, and a heat exchange temperature difference of an indoor heat exchanger.

It will be noted that the second cooling state refers to a cooling state in which a superheat degree of an outlet of the indoor heat exchanger is substantially equal to a first preset value in the cooling state. The first preset value is, for example, 5° C. or 3.5° C. In the cooling state, the operating parameter of the indoor unit 200 includes a sensible heat load (i.e., cooling sensible heat) of the indoor unit 200 in the cooling state.

For example, the user instructs the air conditioner 1000 to be in the cooling state through a remote control device. After receiving a command to start the air conditioner 1000, in response to the start command, the controller 123 controls the compressor 101 of the outdoor unit 300 to start, the first port A and the second port B of the four-way valve 104 to be communicated with each other, the third port C and the fourth port D of the four-way valve 104 to be communicated with each other, the outdoor expansion valve 106 to be fully opened, and the indoor expansion valve (e.g., the first indoor expansion valve 115 and the second indoor expansion valve 117) of the indoor unit 200 to be opened.

Generally, the sensible heat load of the indoor unit 200 in the cooling state is determined by the heat exchange area, the heat exchange coefficient, and the heat exchange temperature difference of the indoor heat exchanger. The heat exchange areas of the indoor heat exchangers corresponding to the indoor units 200 of a same model are the same. Therefore, the heat exchange area may be determined according to the model of the indoor unit. The heat exchange coefficient of the indoor heat exchanger may be determined according to the heat exchange area and a wind speed, and the wind speed of the indoor unit 200 may be controlled by the user.

For example, the wind speed of an indoor unit 200 includes a first wind speed (e.g., a low wind speed), a second wind speed (e.g., a medium wind speed), and a third wind speed (e.g., a high wind speed), and the first wind speed is less than the second wind speed, and the second wind speed is less than the third wind speed. In this case, in a case where the indoor unit 200 is in the cooling state set by the user (e.g., the user instructs that the wind speed is the second wind speed), the heat exchange area and the heat exchange coefficient are determined. Therefore, the sensible heat load of the indoor unit 200 in the cooling state is related to the heat exchange temperature difference of the indoor heat exchanger.

The sensible heat load of the indoor unit 200 in the second cooling state and the corresponding heat exchange temperature difference of the indoor heat exchanger (a state in which the superheat degree of the outlet of the indoor heat exchanger is substantially equal to 5° C. or 3.5° C.) may be fit through tests and simulation results, so as to obtain a functional relationship between the sensible heat load of the indoor unit 200 in the second cooling state and the heat exchange temperature difference. For example, the functional relationship between the sensible heat load of the indoor unit 200 in the second cooling state and the heat exchange temperature difference is as follows:

$$Q1'=A1\times\Delta T+B1. \quad (1)$$

Where Q1' is the operating parameter (i.e., the sensible heat load) of the indoor unit 200 in the second cooling state, A1 and B1 are first fitting parameters, and ΔT is the heat exchange temperature difference.

In this case, the first fitting parameters A1 and B1 may be determined according to the heat exchange area and the heat exchange coefficient of the indoor heat exchanger.

Figure 12:
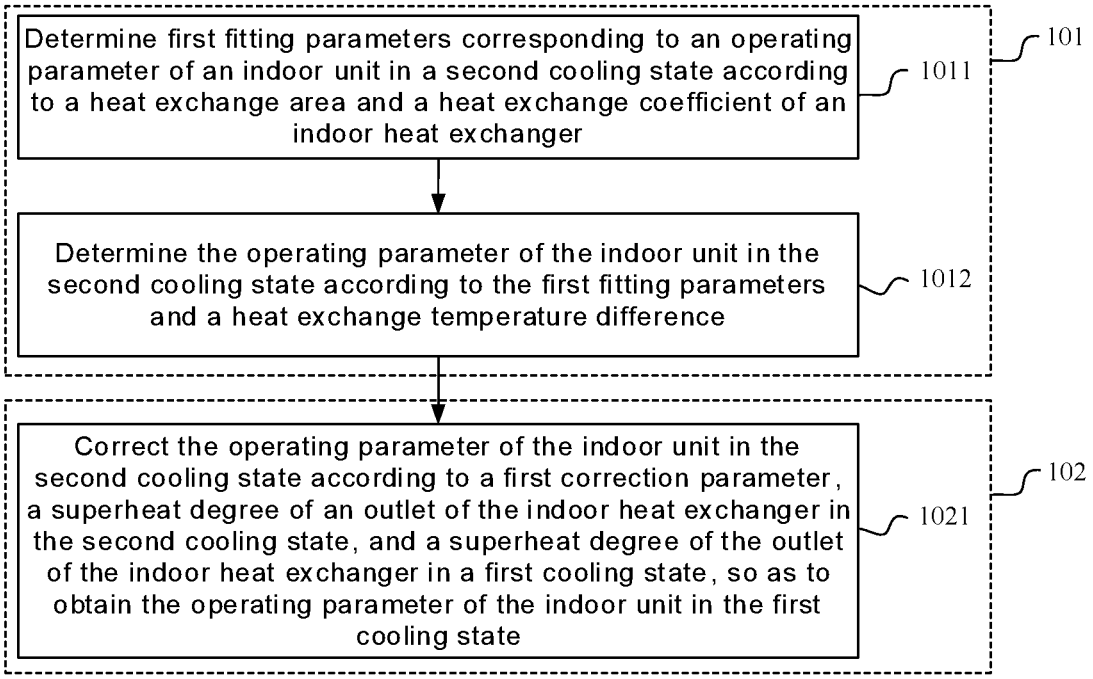
FIG. 12 is another flow chart of a method for calculating an operating parameter of an indoor unit, in accordance with some embodiments.

Therefore, as shown in FIG. 12, the step 101 includes step 1011 and step 1012.

In step 1011, the first fitting parameters corresponding to the operating parameter of the indoor unit in the second cooling state are determined according to the heat exchange area and the heat exchange coefficient of the indoor heat exchanger.

For example, a corresponding relationship between the heat exchange area, the heat exchange coefficient of the indoor heat exchanger, and the first fitting parameters may be stored in the memory 150 of the air conditioner 1000 in advance. In a case where the air conditioner 1000 includes a plurality of indoor units 200, for the indoor unit 200 with each model, the memory 150 has stored the corresponding relationship between the heat exchange area and the heat exchange coefficient of the indoor heat exchanger and the first fitting parameters. For example, the memory 150 has stored a corresponding relationship between the model and the wind speed of the indoor unit 200, and the first fitting parameters, and the corresponding relationship may be as shown in Table 1 below.

TABLE 1

| Heat exchange area corresponding to a model | Heat exchange coefficient corresponding to a wind speed: First heat exchange coefficient corresponding to a first wind speed | Second heat exchange coefficient corresponding to a second wind speed | Third heat exchange coefficient corresponding to a third wind speed |
|---|---|---|---|
| First heat exchange area corresponding to a first model | A11, B11 | A12, B12 | A13, B13 |
| Second heat exchange area corresponding to a second model | A14, B14 | A15, B15 | A16, B16 |

After the heat exchange area and the heat exchange coefficient of the indoor heat exchanger are obtained, the first fitting parameters may be determined according to the corresponding relationship between the heat exchange area and the heat exchange coefficient of the indoor heat exchanger and the first fitting parameters.

For example, it is assumed that the heat exchange area of the indoor heat exchanger of the indoor unit 200 is the first heat exchange area in Table 1 and the wind speed of the indoor unit 200 set by the user is the second wind speed, the value of A1 in the first fitting parameters may be equal to A12, and the value of B1 in the first fitting parameters may be equal to B12.

It will be noted that the memory 150 may store the model of the indoor unit 200 and the heat exchange area corresponding to the model, and the controller 123 may obtain the heat exchange area of the indoor heat exchanger by reading the information in the memory 150, and then obtain the heat exchange coefficient of the indoor heat exchanger according to the heat exchange area and the wind speed of the indoor heat exchanger.

In step 1012, the operating parameter of the indoor unit 200 in the second cooling state is determined according to the first fitting parameters and the heat exchange temperature difference.

In a case where the indoor unit 200 includes the first temperature sensor 124 and the second temperature sensor 125, the heat exchange temperature difference of the indoor heat exchanger (i.e., the evaporator) is a difference between the temperature detected by the first temperature sensor 124 and the temperature detected by the second temperature sensor.

For example, for the first indoor unit 201, if the temperature of the air inlet of the first indoor unit 201 detected by the first temperature sensor 124 is Ti, and the temperature of the first indoor liquid pipe 131 detected by the second temperature sensor 125 is Tl, the heat exchange temperature difference ΔT may be obtained by the following formula:

$$\Delta T = Ti - Tl. \tag{2}$$

In a case where the indoor unit 200 includes the first temperature sensor 124 and the fourth temperature sensor 127, the heat exchange temperature difference of the indoor heat exchanger is a difference between the temperature detected by the first temperature sensor 124 and the temperature detected by the fourth temperature sensor 127.

For example, for the first indoor unit 201, if the temperature of the air inlet of the first indoor unit 201 detected by the first temperature sensor 124 is Ti, and the temperature of the coil of the corresponding first indoor heat exchanger 116 detected by the fourth temperature sensor 127 is Tu, the heat exchange temperature difference ΔT may be obtained by the following formula:

$$\Delta T = Ti - Tu. \tag{3}$$

In a case where the indoor unit 200 includes the first temperature sensor 124 and the first pressure sensor 128, the heat exchange temperature difference of the indoor heat exchanger is a difference between the temperature detected by the first temperature sensor 124 and the first saturation temperature corresponding to the pressure (i.e., the pressure of the outlet of the indoor heat exchanger) detected by the first pressure sensor 128.

For example, for a corresponding relationship between the pressure of the outlet of the indoor heat exchanger and the first saturation temperature, reference may be made to Table 2.

TABLE 2

| Pressure of an outlet of an indoor heat exchanger | First saturation temperature |
|---|---|
| Pe | Te |
| Pc | Tc |

As shown in Table 2, for the first indoor unit 201, if the temperature of the air inlet of the first indoor unit 201 detected by the first temperature sensor 124 is Ti, and the pressure of the outlet of the corresponding first indoor heat exchanger 116 detected by the first pressure sensor 128 is Pe, the first saturation temperature corresponding to the pressure Pe of the outlet of the first indoor heat exchanger 116 is Te, and the heat exchange temperature difference ΔT may be obtained by the following formula:

$$\Delta T = Ti - Te. \tag{4}$$

It can be understood that, after obtaining the first fitting parameters and the heat exchange temperature difference, the controller 123 may calculate the operating parameter (i.e., the sensible heat load or the cooling sensible heat) of the indoor unit 200 in the second cooling state according to the functional relationship between the sensible heat load of the indoor unit 200 in the second cooling state and the heat exchange temperature difference.

For example, A1 equal to A12, B1 equal to B12, and the heat exchange temperature difference ΔT equal to the difference between the temperature Ti and the first saturation temperature Te (i.e., ΔT=Ti−Te) are substituted into the formula (1), so that the operating parameter Q1' of the indoor unit 200 in the second cooling state may be calculated.

In step 102, an operating parameter of the indoor unit 200 in a first cooling state is determined according to a superheat degree of the outlet of the indoor heat exchanger in the first cooling state, a superheat degree of the outlet of the indoor heat exchanger in the second cooling state, and the operating parameter of the indoor unit 200 in the second cooling state.

It will be noted that in a case where the air conditioner 1000 is in the cooling state, the indoor heat exchanger (e.g., the first indoor heat exchanger 116 and the second indoor heat exchanger 118) operates as an evaporator.

The superheat degree of the outlet of the evaporator in the second cooling state may be preset with different values according to arrangement positions of the different sensors. For example, the superheat degree of the outlet of the evaporator in the second cooling state is preset to 5° C. or 3.5° C.

Therefore, as shown in FIG. 12, the step 102 includes step 1021.

In step 1021, the operating parameter of the indoor unit 200 in the second cooling state is corrected according to a first correction parameter, the superheat degree of the outlet of the indoor heat exchanger in the second cooling state, and the superheat degree of the outlet of the indoor heat exchanger in the first cooling state, so as to obtain the operating parameter of the indoor unit 200 in the first cooling state.

The first correction parameter is used to represent an influence of the superheat degree of the outlet of the evaporator (i.e., the indoor heat exchanger) on the operating parameter of the indoor unit 200.

In some embodiments, the first correction parameter may be a constant value. It can be understood that the first correction parameter is independent of the model and the wind speed of the indoor unit 200. In this way, the controller 123 only needs to obtain the constant first correction parameter when calculating the operating parameter of the indoor unit 200 in the first cooling state, and there is no need for the controller 123 to obtain different first correction parameters according to the model and the wind speed of the indoor unit 200, so as to simplify the calculation, improve the calculation efficiency, and save the power consumption of the operating controller 123.

In some other embodiments, the first correction parameter may be related to the model and the wind speed of the indoor unit 200. That is to say, the first correction parameter may be related to the heat exchange area and the heat exchange coefficient of the indoor heat exchanger. Generally, a corresponding relationship between the heat exchange area and the heat exchange coefficient of the indoor heat exchanger and the first correction parameter may be stored in the memory 150. In step 1021, the controller 123 may obtain the first correction parameter according to the heat exchange area and the heat exchange coefficient of the indoor heat exchanger. In this way, the corrected operating parameter of the indoor unit 200 may be accurately obtained, which is helpful for the controller 123 to precisely control the entire air conditioner 1000, so that the power consumption may be saved in a case where the air conditioner 1000 has a good cooling effect.

It will be noted that the superheat degree of the outlet of the indoor heat exchanger (e.g., the first indoor heat exchanger 116 and the second indoor heat exchanger 118) in the first cooling state may be obtained by a plurality of sensors disposed in the indoor unit 200.

For example, in a case where the indoor unit 200 includes the second temperature sensor 125 and the third temperature sensor 126, the superheat degree of the outlet of the indoor heat exchanger in the first cooling state may be the difference between the temperature detected by the second temperature sensor 125 and the temperature detected by the third temperature sensor 126.

For example, for the first indoor unit 201, if the temperature of the first indoor liquid pipe 131 of the first indoor heat exchanger 116 detected by the second temperature sensor 125 is T1, the temperature of the first indoor gaseous pipe 141 of the first indoor heat exchanger 116 detected by the third temperature sensor 126 is Tg, the superheat degree SH1 of the outlet of the evaporator (i.e., the first indoor heat exchanger 116) in the first cooling state may be obtained by the following formula:

$$SH1=Tg-Tl. \tag{5}$$

In a case where the indoor unit 200 includes the third temperature sensor 126 and the fourth temperature sensor 127, the superheat degree of the outlet of the indoor heat exchanger in the first cooling state may be the difference between the temperature detected by the third temperature sensor 126 and the temperature detected by the fourth temperature sensor 127.

For example, for the first indoor unit 201, if the temperature of the coil of the first indoor heat exchanger 116 detected by the fourth temperature sensor 127 is Tu, the temperature of the first indoor gaseous pipe 141 of the first indoor heat exchanger 116 detected by the third temperature sensor 126 is Tg, the superheat degree SH1 of the outlet of the evaporator in the first cooling state may be obtained by the following formula:

$$SH1=Tg-Tu. \tag{6}$$

In a case where the indoor unit 200 includes the third temperature sensor 126 and the first pressure sensor 128, the superheat degree of the outlet of the indoor heat exchanger in the first cooling state may be the difference between the temperature detected by the third temperature sensor 126 and the first saturation temperature corresponding to the pressure detected by the first pressure sensor 128.

For example, if the temperature of the first indoor gaseous pipe 141 of the first indoor heat exchanger 116 detected by the third temperature sensor 126 is Tg, and the pressure of the outlet of the first indoor heat exchanger 116 detected by the first pressure sensor 128 is Pe, it may be obtained that the first saturation temperature corresponding to the pressure Pe is Te with reference to Table 2. In this way, the superheat degree of the outlet of the evaporator in the first cooling state may be obtained by the following formula:

$$SH1=Tg-Te. \tag{7}$$

It will be noted that in the second cooling state, the simulation and test of the operating parameter of the indoor unit 200 are performed in a case of the superheat degree of the outlet of the indoor heat exchanger being 5° C. or 3.5° C. Therefore, in a case where the superheat degree of the outlet of the indoor heat exchanger is not 5° C. or 3.5° C. when the indoor unit 200 is operating in the first cooling state, there is deviation in the operating parameter of the indoor unit 200 obtained through the formula (1).

In this case, the operating parameter (i.e., the operating parameter of the indoor unit 200 in the second cooling state) of the indoor unit 200 obtained through the formula (1) may be corrected according to the superheat degree of the outlet of the indoor heat exchanger in the first cooling state, the superheat degree of the outlet of the indoor heat exchanger in the second cooling state, and the first correction parameter, so as to obtain an accurate operating parameter of the indoor unit 200 in the first cooling state. For example, the following formula is used to calculate the operating parameter of the indoor unit 200 in the first cooling state.

$$Q1=[(SH1'-SH1)\times G+1]\times Q1'. \quad (8)$$

Where Q1 represents the operating parameter of the indoor unit 200 in the first cooling state, SH1 represents the superheat degree of the outlet of the indoor heat exchanger in the first cooling state, and SH1' represents the superheat degree (e.g., 5° C. or 3.5° C.) of the outlet of the indoor heat exchanger in the second cooling state. G is the first correction parameter, and Q1' represents the operating parameter of the indoor unit 200 in the second cooling state.

In this way, the operating parameter of the indoor unit 200 in the first cooling state may be calculated by substituting the operating parameter in the second cooling state obtained through the calculation of the steps, the superheat degree of the outlet of the indoor heat exchanger in the first cooling state, the superheat degree of the outlet of the indoor heat exchanger in the second cooling state, and the first correction parameter into the formula (8).

It will be noted that the compressor 201, the outdoor expansion valve 106, and the indoor expansion valve (e.g., the first indoor expansion valve 115 and the second indoor expansion valve 117) may be adjusted according to the operating parameter of the indoor unit 200 after the operating parameter of the indoor unit 200 in the first cooling state is obtained by calculation, so that the cooling effect of the air conditioner 1000 in the cooling state may be improved and the energy consumption may be saved.

In addition, in a case where different sensors are used to collect temperatures or pressures, the superheat degree of the outlet of the evaporator in the second cooling state is set to different values.

For example, in a case where the heat exchange temperature difference is obtained through the first temperature sensor 124 and the second temperature sensor 125, and the superheat degree is obtained through the second temperature sensor 124 and the third temperature sensor 126, the superheat degree of the outlet of the evaporator in the second cooling state may be 3.5° C.

For another example, in a case where the heat exchange temperature difference is obtained through the first temperature sensor 124 and the fourth temperature sensor 127, and the superheat degree is obtained through the fourth temperature sensor 127 and the third temperature sensor 126, the superheat degree of the outlet of the evaporator in the second cooling state may be 5° C.

For another example, in a case where the heat exchange temperature difference is obtained through the first temperature sensor 124 and the first pressure sensor 128, and the superheat degree is obtained through the third temperature sensor 126 and the first pressure sensor 128, the superheat degree of the outlet of the evaporator in the second cooling state may be 5° C.

Figure 13:
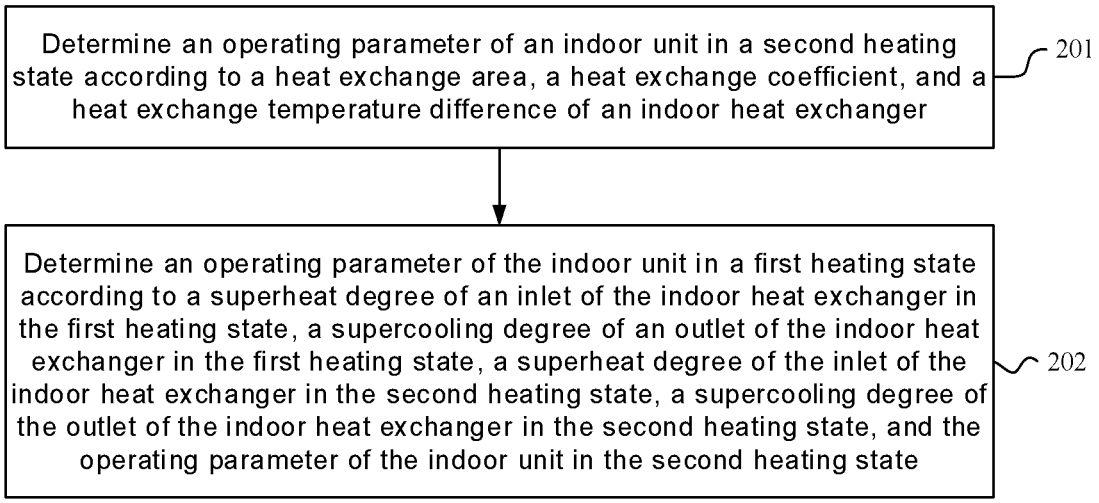
FIG. 13 is yet another flow chart of a method for calculating an operating parameter of an indoor unit, in accordance with some embodiments.

In some embodiments, the method may also calculate an operating parameter of the indoor unit 200 in the heating state. As shown in FIG. 13, in the heating state, the method for calculating the operating parameter of the indoor unit 200 includes step 201 and step 202.

In step 201, an operating parameter of the indoor unit in a second heating state is determined according to the heat exchange area, the heat exchange coefficient, and the heat exchange temperature difference of the indoor heat exchanger.

It will be noted that the second heating state refers to a heating state in which a superheat degree of an inlet of the indoor heat exchanger is substantially equal to a second preset value, and a supercooling degree of the outlet of the indoor heat exchanger is substantially equal to a third preset value in the heating state. The second preset value is, for example, 30° C. The third preset value is, for example, 15° C. In the heating state, the operating parameter of the indoor unit 200 includes a sensible heat load (i.e., heating sensible heat) of the indoor unit 200 in the heating state.

For example, the user instructs the air conditioner 1000 to be in the heating state through the remote control device. After receiving an instruction to start the air conditioner 1000, in response to the start instruction, the controller 123 controls the compressor 101 of the outdoor unit 300 to start, the first port A and the third port C of the four-way valve 104 to be communicated with each other, the second port B and the fourth port D of the four-way valve 104 to be communicated with each other, the outdoor expansion valve 106 to be fully opened, and the indoor expansion valve (e.g., the first indoor expansion valve 115 and the second indoor expansion valve 117) of the indoor unit 200 to be opened.

Similar to the functional relationship between the sensible heat load and the heat exchange temperature difference of the indoor unit 200 in the second cooling state, a functional relationship between the sensible heat load and the heat exchange temperature difference of the indoor unit 200 in the second heating state is, for example, as the following formula:

$$Q2'=C1\times\Delta T+D1. \quad (9)$$

Where Q2' is the sensible heat load of the indoor unit 200 in the second heating state, C1 and D1 are second fitting parameters, and ΔT is the heat exchange temperature difference.

Similar to the first fitting parameters A1 and B1, the second fitting parameters C1 and D1 may also be determined by the heat exchange area and the heat exchange coefficient of the indoor heat exchanger.

Figure 14:
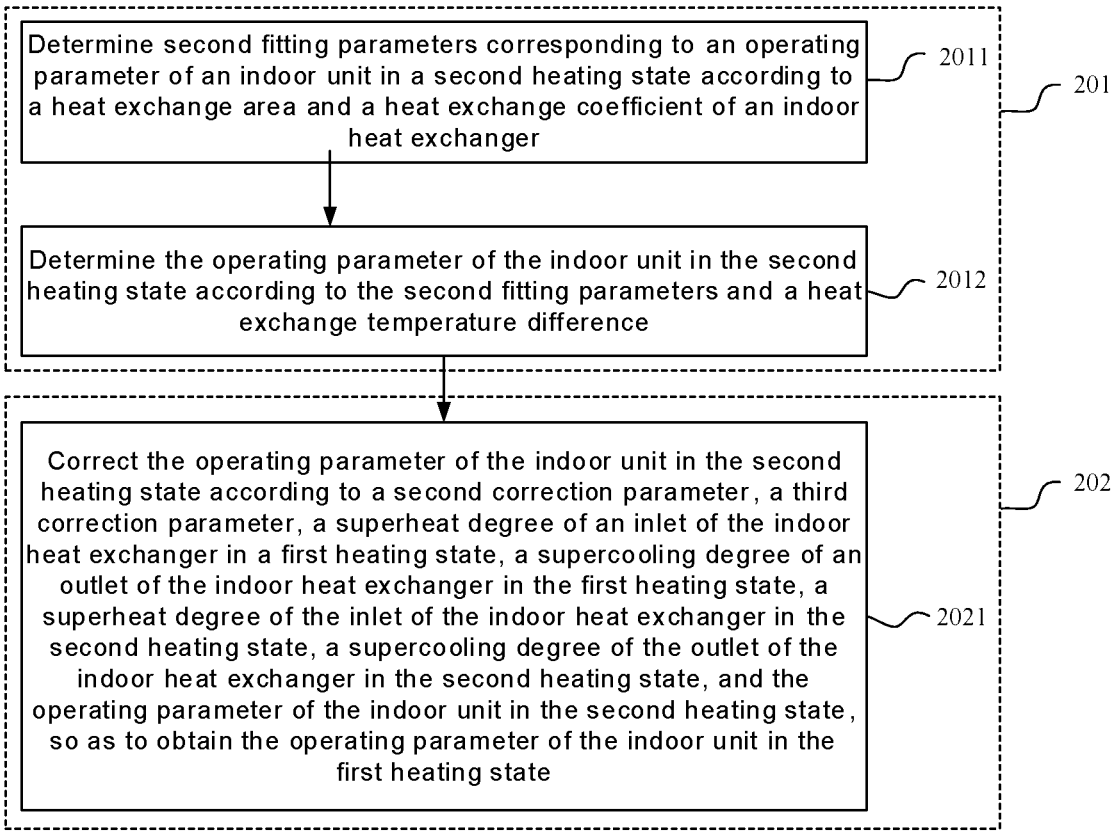
FIG. 14 is yet another flow chart of a method for calculating an operating parameter of an indoor unit, in accordance with some embodiments.

Therefore, as shown in FIG. 14, the step 201 includes step 2011 and step 2012.

In step 2011, the second fitting parameters corresponding to the operating parameter of the indoor unit 200 in the second heating state are determined according to the heat exchange area and the heat exchange coefficient of the indoor heat exchanger.

It can be understood that the process of determining the second fitting parameters is similar to that of the step 1011, and details will not be repeated herein.

In step 2012, the operating parameter of the indoor unit 200 in the second heating state is determined according to the second fitting parameters and the heat exchange temperature difference.

In a case where the indoor unit 200 includes the first temperature sensor 124 and the outdoor unit 300 includes the second pressure sensor 129, the heat exchange temperature difference of the indoor heat exchanger (i.e., the condenser) is the difference between of the temperature detected by the first temperature sensor 124 and the second saturation temperature corresponding to the pressure detected by the second pressure sensor 129.

For example, for a corresponding relationship between the pressure (i.e., the pressure detected by the second pressure sensor 129) of the exhaust pipe 1012 of the compressor 101 and the second saturation temperature, reference may be made to Table 3.

TABLE 3

| Pressure of an outlet of a compressor | Second saturation temperature |
|---|---|
| Ph | Th |
| Pd | Td |

As shown in Table 3, for the first indoor unit 201, if the temperature of the air inlet of the first indoor unit 201 detected by the first temperature sensor 124 is Ti, and the pressure detected by the second pressure sensor 129 is Pd, the second saturation temperature corresponding to the pressure Pd detected by the second pressure sensor 129 is Td. The heat exchange temperature difference ΔT may be obtained by the following formula:

$$\Delta T = Td - Ti. \tag{10}$$

After obtaining the second fitting parameters and the heat exchange temperature difference, the controller 123 may calculate the operating parameter of the indoor unit 200 in the second heating state according to the functional relationship between the sensible heat load of the indoor unit 200 in the heating state and the heat exchange temperature difference.

In step 202, an operating parameter of the indoor unit 200 in a first heating state is determined according to the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit 200 in the second heating state. The first heating state refers to the current heating state of the indoor unit 200.

In the second heating state, the superheat degree of the inlet of the condenser (e.g., the first indoor heat exchanger 116 and the second indoor heat exchanger 118) may be, for example, 33° C., 30° C., or 27° C., and the supercooling degree of the outlet of the condenser may be, for example, 18° C., 15° C., or 12° C.

Therefore, as shown in FIG. 14, the step 202 includes step 2021.

In step 2021, the operating parameter of the indoor unit 200 in the second heating state is corrected according to a second correction parameter, a third correction parameter, the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit 200 in the second heating state, so as to obtain the operating parameter of the indoor unit 200 in the first heating state.

Here, the second correction parameter represents an influence of the superheat degree of the inlet of the condenser on the operating parameter of the indoor unit 200. The third correction parameter represents an influence of the supercooling degree of the outlet of the condenser on the operating parameter of the indoor unit 200.

In some embodiments, the second correction parameter and the third correction parameter may be constant values. That is to say, the second correction parameter and the third correction parameter are independent of the model and the wind speed of the indoor unit 200. In this way, the controller 123 only needs to obtain the constant second correction parameter and the constant third correction parameter when calculating the operating parameter of the indoor unit 200 in the first heating state, and there is no need for the controller 123 to obtain different second correction parameters and different third correction parameters according to the model and the wind speed of the indoor unit 200, so as to simplify the calculation, improve the calculation efficiency, and save the power consumption of the operating controller 123.

In some other embodiments, the second correction parameter and the third correction parameter may be related to the model and the wind speed of the indoor unit 200. That is to say, the second correction parameter and the third correction parameter may be related to the heat exchange area and the heat exchange coefficient of the indoor heat exchanger. Generally, the memory 150 may store a corresponding relationship between the heat exchange area and heat exchange coefficient of the indoor heat exchanger and the second correction parameter and the third correction parameter.

In step 2021, the controller 123 may obtain the second correction parameter and the third correction parameter according to the heat exchange area and heat exchange coefficient of the indoor heat exchanger. In this way, the corrected operating parameter of the indoor unit 200 may be accurately obtained, which is helpful for the controller 123 to precisely control the entire air conditioner 1000, so that the power consumption may be saved in a case where the air conditioner 1000 has a good heating effect.

In addition, the superheat degree of the inlet of the indoor heat exchanger in the first heating state and the supercooling degree of the outlet of the indoor heat exchanger in the first heating state may be obtained through the plurality of first sensors disposed in the indoor unit 200 and the second sensor disposed in the outdoor unit 300.

The superheat degree of the inlet of the condenser in the first heating state may be calculated according to the saturation temperature corresponding to the pressure of the exhaust pipe 1012 of the compressor 101 and the temperature (e.g., the temperature of the first indoor gaseous pipe 141 or the second indoor gaseous pipe 142) of the inlet of the condenser. The supercooling degree of the outlet of the condenser in the first heating state may be calculated according to the saturation temperature corresponding to the pressure of the exhaust pipe 1012 of the compressor 101 and the temperature (e.g., the temperature of the first indoor liquid pipe 131 or the second indoor liquid pipe 132) of the outlet of the condenser.

As shown in FIG. 10, the pressure of the exhaust pipe 1012 of the compressor 101 is detected by the second pressure sensor 129, the temperature of the inlet of the condenser is detected by the third temperature sensor 126, and the temperature of the outlet of the condenser is detected by the second temperature sensor 125. Then, the corresponding saturation temperature (i.e., the second saturation temperature) is obtained according to the pressure of the exhaust pipe 1012 of the compressor 101.

The superheat degree of the inlet of the condenser in the first heating state is the difference between the temperature of the inlet of the indoor heat exchanger and the second saturation temperature, and the supercooling degree of the outlet of the condenser in the first heating state is the difference between the temperature of the outlet of the indoor heat exchanger and the second saturation temperature.

For example, considering the first indoor unit 201 as an example, if the temperature of the first indoor gaseous pipe 141 of the first indoor heat exchanger 116 detected by the third temperature sensor 126 is Tg, the temperature of the first indoor liquid pipe 131 of the first indoor heat exchanger 116 detected by the second temperature sensor 125 is T1, and the pressure detected by the second pressure sensor 129 is Pd. The second saturation temperature corresponding to Pd is Td with reference to Table 3. The superheat degree TSH of the inlet of the condenser (i.e., the indoor heat exchanger 116) in the first heating state may be obtained through the following formula:

$$TSH=Tg-Td. \quad (11)$$

Therefore, the supercooling degree TSC of the outlet of the condenser in the first heating state may be obtained by the following formula:

$$TSC=Td-Tl. \quad (12)$$

It will be noted that, in the second heating state, the simulation and test of the operating parameter of the indoor unit 200 are performed on a condition that the superheat degree of the inlet of the indoor heat exchanger is equal to 30° C. and the supercooling degree of the outlet of the indoor heat exchanger is equal to 15° C. Therefore, in a case where the superheat degree of the inlet of the indoor heat exchanger is not 30° C. or the supercooling degree of the outlet of the indoor heat exchanger is not 15° C. when the indoor unit 200 operates in the first heating state, there is deviation in the operating parameter of the indoor unit 200 obtained through the formula (9).

In this case, the operating parameter (i.e., the operating parameter of the indoor unit 200 in the second heating state) of the indoor unit 200 obtained through the formula (9) is corrected according to the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, the second correction parameter, and the third correction parameter, so as to obtain the operating parameter of the indoor unit 200 in the first heating state. For example, the following formula is used to calculate the operating parameter of the indoor unit 200 in the first cooling state.

$$Q2=[(TSH-TSH')\times E1+(TSC'-TSC)\times F1+1]\times Q2'. \quad (13)$$

Where Q2 represents the operating parameter of the indoor unit 200 in the first heating state, Q2' represents the operating parameter of the indoor unit 200 in the second heating state, TSH' represents the superheat degree (e.g., 30° C.) of the inlet of the condenser in the second heating state, TSC' represents the supercooling degree (e.g., 15° C.) of the outlet of the condenser in the second heating state, E1 is the second correction parameter, and F1 is the third correction parameter.

The operating parameter of the indoor unit 200 in the first heating state may be calculated by substituting the operating parameter of the indoor unit 200 in the second heating state obtained through the calculation of the steps, the superheat degree of the inlet of the indoor heat exchanger in the first heating state, the superheat degree of the inlet of the indoor heat exchanger in the second heating state, the supercooling degree of the outlet of the indoor heat exchanger in the first heating state, the supercooling degree of the outlet of the indoor heat exchanger in the second heating state, the second correction parameter, and the third correction parameter into the formula (13).

It will be noted that the compressor 101, the outdoor expansion valve 106, and the indoor expansion valve (e.g., the first indoor expansion valve 115 and the second indoor expansion valve 117) may be adjusted according to the operating parameter of the indoor unit 200 after the operating parameter of the indoor unit 200 in the first heating state is obtained by calculation, so that the heating effect of the air conditioner 1000 in the heating state may be improved and the energy consumption may be saved.

In the above description of the embodiments, specific features, structures, materials, or characteristics may be combined in a suitable manner in any one or more embodiments or examples.

A person skilled in the art will understand that the scope of disclosure in the present disclosure is not limited to specific embodiments discussed above and may modify and substitute some elements of the embodiments without departing from the spirits of the present disclosure. The scope of the present disclosure is limited by the appended claims.

What is claimed is:

1. An air conditioner, comprising:

an outdoor unit, including a compressor, a four-way valve, an outdoor heat exchanger, and an outdoor expansion valve;

an indoor unit, including:

an indoor expansion valve;

an indoor heat exchanger, wherein the compressor, the four-way valve, the outdoor heat exchanger, the outdoor expansion valve, the indoor expansion valve, and the indoor heat exchanger are sequentially connected, so as to provide a refrigerant circulation; and a plurality of first sensors configured to detect at least one of a temperature or a pressure of the refrigerant circulation, so as to permit a controller to determine a superheat degree of an outlet of the indoor heat exchanger and a heat exchange temperature difference of the indoor heat exchanger that are in a first cooling state, the first cooling state referring to a current cooling state of the indoor unit; and the controller configured to:

in a case where the air conditioner is in a cooling mode, determine an operating parameter of the indoor unit in a second cooling state according to a heat exchange area, a heat exchange coefficient, and the heat exchange temperature difference of the indoor heat exchanger; the heat exchange coefficient of the indoor heat exchanger being determined according to the heat exchange area and a wind speed; the second cooling state referring to a cooling state in which the superheat degree of the outlet of the indoor heat exchanger is substantially equal to a first preset value in the cooling mode; the operating parameter of the indoor unit in the second cooling state including a sensible heat load of the indoor unit in the second cooling state; and determine an operating parameter of the indoor unit in the first cooling state according to the superheat degree of the outlet of the indoor heat exchanger in the first cooling state, the superheat degree of the outlet of the indoor heat exchanger in the second cooling state, and the operating parameter of the indoor unit in the second cooling state.

2. The air conditioner according to claim 1, wherein the controller is further configured to:

determine first fitting parameters corresponding to the operating parameter of the indoor unit in the second cooling state according to the heat exchange area and the heat exchange coefficient of the indoor heat exchanger; and determine the operating parameter of the indoor unit in the second cooling state according to the first fitting parameters and the heat exchange temperature difference.

3. The air conditioner according to claim 1, wherein the controller is further configured to:

correct the operating parameter of the indoor unit in the second cooling state according to a first correction parameter, the superheat degree of the outlet of the indoor heat exchanger in the second cooling state, and the superheat degree of the outlet of the indoor heat exchanger in the first cooling state, so as to obtain the operating parameter of the indoor unit in the first cooling state;

wherein the first correction parameter represents an influence of the superheat degree of the outlet of the indoor heat exchanger on the operating parameter of the indoor unit in the second cooling state.

4. The air conditioner according to claim 3, wherein the first correction parameter satisfies one of following:

the first correction parameter is a constant value; and the first correction parameter is related to the heat exchange area and the heat exchange coefficient of the indoor heat exchanger.

5. The air conditioner according to claim 1, wherein the indoor unit further includes an indoor liquid pipe and an indoor gaseous pipe, the indoor liquid pipe, the indoor expansion valve, the indoor heat exchanger, and the indoor gaseous pipe are connected in sequence, the indoor liquid pipe includes a pipeline located on a side of the indoor heat exchanger proximate to the indoor expansion valve, the gaseous pipe includes a pipeline located on a side of the indoor heat exchanger away from the indoor expansion valve;

the plurality of first sensors include:

a first temperature sensor disposed at an air inlet of the indoor heat exchanger and configured to detect a temperature of an air inlet of the indoor unit;

a second temperature sensor disposed on the indoor liquid pipe and configured to detect a temperature of the indoor liquid pipe; and a third temperature sensor disposed on the indoor gaseous pipe and configured to detect a temperature of the indoor gaseous pipe;

the controller is further configured to:

in a case where the air conditioner is in the cooling mode, determine the heat exchange temperature difference according to the temperature detected by the first temperature sensor and the temperature detected by the second temperature sensor; and determine the superheat degree of the outlet of the indoor heat exchanger in the first cooling state according to the temperature detected by the second temperature sensor and the temperature detected by the third temperature sensor.

6. The air conditioner according to claim 1, wherein the indoor unit further includes an indoor gaseous pipe, the indoor expansion valve, the indoor heat exchanger, and the indoor gaseous pipe are connected in sequence, the gaseous pipe includes a pipeline located on a side of the indoor heat exchanger away from the indoor expansion valve;

the plurality of first sensors include:

a first temperature sensor disposed at an air inlet of the indoor heat exchanger and configured to detect a temperature of an air inlet of the indoor unit;

a third temperature sensor disposed on the indoor gaseous pipe and configured to detect a temperature of the indoor gaseous pipe; and a fourth temperature sensor disposed on a coil of the indoor heat exchanger and configured to detect a temperature of the coil of the indoor heat exchanger;

the controller is further configured to:

in a case where the air conditioner is in the cooling mode, determine the heat exchange temperature difference according to the temperature detected by the first temperature sensor and the temperature detected by the fourth temperature sensor; and determine the superheat degree of the outlet of the indoor heat exchanger in the first cooling state according to the temperature detected by the third temperature sensor and the temperature detected by the fourth temperature sensor.

7. The air conditioner according to claim 1, wherein the indoor unit further includes an indoor gaseous pipe, the indoor expansion valve, the indoor heat exchanger, and the indoor gaseous pipe are connected in sequence, the gaseous pipe includes a pipeline located on a side of the indoor heat exchanger away from the indoor expansion valve;

the plurality of first sensors include:

a first temperature sensor disposed at an air inlet of the indoor heat exchanger and configured to detect a temperature of an air inlet of the indoor unit;

a third temperature sensor disposed on the indoor gaseous pipe and configured to detect a temperature of the indoor gaseous pipe; and a first pressure sensor disposed at the outlet of the indoor heat exchanger and configured to detect a pressure of the outlet of the indoor heat exchanger;

the controller is further configured to:

in a case where the air conditioner is in the cooling mode, determine a first saturation temperature corresponding to the pressure detected by the first pressure sensor;

determine the heat exchange temperature difference according to the temperature detected by the first temperature sensor and the first saturation temperature; and determine the superheat degree of the outlet of the indoor heat exchanger in the first cooling state according to the temperature detected by the third temperature sensor and the first saturation temperature.

8. The air conditioner according to claim 1, wherein the outdoor unit further includes a second sensor; the second sensor is configured to detect a pressure of the refrigerant circulation, so as to make the controller determine a superheat degree of an inlet of the indoor heat exchanger, a supercooling degree of an outlet of the indoor heat exchanger, and a heat exchange temperature difference of the indoor heat exchanger that are in a first heating state according to detecting values of the plurality of first sensors and a detecting value second sensor, the first heating state refers to a current heating state of the indoor unit;

the controller is further configured to:

in a case where the air conditioner is in a heating mode, determine an operating parameter of the indoor unit in a second heating state according to the heat exchange area, the heat exchange coefficient, and the heat exchange temperature difference of the indoor heat exchanger; the second heating state referring to a heating state in which the superheat degree of the inlet of the indoor heat exchanger is substantially equal to a second preset value, and the supercooling degree of the outlet of the indoor heat exchanger is substantially equal to a third preset value in the heating mode; the operating parameter of the indoor unit in the second heating state including a sensible heat load of the indoor unit in the second heating state; and determine an operating parameter of the indoor unit in the first heating state according to the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit in the second heating state.

9. The air conditioner according to claim 8, wherein the controller is further configured to:

determine second fitting parameters corresponding to the operating parameter of the indoor unit in the second heating state according to the heat exchange area and the heat exchange coefficient of the indoor heat exchanger; and determine the operating parameter of the indoor unit in the second heating state according to the second fitting parameters and the heat exchange temperature difference.

10. The air conditioner according to claim 8, wherein the controller is further configured to:

correct the operating parameter of the indoor unit in the second heating state according to a second correction parameter, a third correction parameter, the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit in the second heating state, so as obtain the operating parameter of the indoor unit in the first heating state;

wherein the second correction parameter represents an influence of the superheat degree of the inlet of the indoor heat exchanger on the operating parameter of the indoor unit in the second heating state; and the third correction parameter represents an influence of the supercooling degree of the outlet of the indoor heat exchanger on the operating parameter of the indoor unit in the second heating state.

11. The air conditioner according to claim 10, wherein the second correction parameter and the third correction parameter satisfy one of following:

the second correction parameter and the third correction parameter are constant values; and the second correction parameter and the third correction parameter each are related to the heat exchange area and the heat exchange coefficient of the indoor heat exchanger.

12. The air conditioner according to claim 8, wherein the indoor unit further includes an indoor liquid pipe and an indoor gaseous pipe, the indoor liquid pipe, the indoor expansion valve, the indoor heat exchanger, and the indoor gaseous pipe are connected in sequence, the indoor liquid pipe includes a pipeline located on a side of the indoor heat exchanger proximate to the indoor expansion valve, the gaseous pipe includes a pipeline located on a side of the indoor heat exchanger away from the indoor expansion valve;

the second sensor includes a second pressure sensor disposed on an exhaust pipe of the compressor and configured to detect a pressure of the exhaust pipe of the compressor;

the plurality of first sensors include:

a first temperature sensor disposed at an air inlet of the indoor heat exchanger and configured to detect a temperature of an air inlet of the indoor unit;

a second temperature sensor disposed on the indoor liquid pipe and configured to detect a temperature of the indoor liquid pipe; and a third temperature sensor disposed on the indoor gaseous pipe and configured to detect a temperature of the indoor gaseous pipe;

the controller is further configured to:

in a case where the air conditioner is in the heating mode, determine a second saturation temperature corresponding to the pressure detected by the second pressure sensor;

determine the heat exchange temperature difference of the indoor unit according to the temperature detected by the first temperature sensor and the second saturation temperature;

determine the superheat degree of the inlet of the indoor heat exchanger according to the second saturation pressure and the temperature detected by the third temperature sensor; and determine the supercooling degree of the outlet of the indoor heat exchanger according to the second saturation pressure and the temperature detected by the second temperature sensor.

13. A method for calculating an operating parameter of an indoor unit, applied to an air conditioner, and the air conditioner including:

an outdoor unit, including a compressor, a four-way valve, an outdoor heat exchanger, and an outdoor expansion valve; and an indoor unit, including:

an indoor expansion valve;

an indoor heat exchanger, wherein the compressor, the four-way valve, the outdoor heat exchanger, the outdoor expansion valve, the indoor expansion valve, and the indoor heat exchanger are sequentially connected, so as to provide a refrigerant circulation; and a plurality of first sensors configured to detect at least one of a temperature or a pressure of the refrigerant circulation, so as to make a controller determine a superheat degree of an outlet of the indoor heat exchanger and a heat exchange temperature difference of the indoor heat exchanger that are in a first cooling state, the first cooling state referring to a current cooling state of the indoor unit;

wherein the method comprises:

in a case where the air conditioner is in a cooling mode, determining an operating parameter of the indoor unit in a second cooling state according to a heat exchange area, a heat exchange coefficient, and the heat exchange temperature difference of the indoor heat exchanger; the heat exchange coefficient of the indoor heat exchanger being determined according to the heat exchange area and a wind speed; the second cooling state referring to a cooling state in which the superheat degree of the outlet of the indoor heat exchanger is substantially equal to a first preset value in the cooling mode; the operating parameter of the indoor unit in the second cooling state including a sensible heat load of the indoor unit in the second cooling state; and determining an operating parameter of the indoor unit in the first cooling state according to the superheat degree of the outlet of the indoor heat exchanger in the first cooling state, the superheat degree of the outlet of the indoor heat exchanger in the second cooling state, and the operating parameter of the indoor unit in the second cooling state.

14. The method according to claim 13, wherein determining the operating parameter of the indoor unit in the second cooling state according to the heat exchange area, the heat exchange coefficient, and the heat exchange temperature difference of the indoor heat exchanger, includes:

determining first fitting parameters corresponding to the operating parameter of the indoor unit in the second cooling state according to the heat exchange area and the heat exchange coefficient of the indoor heat exchanger; and determining the operating parameter of the indoor unit in the second cooling state according to the first fitting parameters and the heat exchange temperature difference.

15. The method according to claim 13, wherein determining the operating parameter of the indoor unit in the first cooling state according to the superheat degree of the outlet of the indoor heat exchanger in the first cooling state, the superheat degree of the outlet of the indoor heat exchanger in the second cooling state, and the operating parameter of the indoor unit in the second cooling state, includes:

correcting the operating parameter of the indoor unit in the second cooling state according to a first correction parameter, the superheat degree of the outlet of the indoor heat exchanger in the second cooling state, and the superheat degree of the outlet of the indoor heat exchanger in the first cooling state, so as to obtain the operating parameter of the indoor unit in the first cooling state;

wherein the first correction parameter represents an influence of the superheat degree of the outlet of the indoor heat exchanger on the operating parameter of the indoor unit in the second cooling state.

16. The method according to claim 15, wherein the first correction parameter satisfies one of following:

the first correction parameter is a constant value; and the first correction parameter is related to the heat exchange area and the heat exchange coefficient of the indoor heat exchanger.

17. The method according to claim 13, wherein the outdoor unit further includes a second sensor; the second sensor is configured to detect a pressure of the refrigerant circulation, so as to make the controller determine a superheat degree of an inlet of the indoor heat exchanger, a supercooling degree of an outlet of the indoor heat exchanger, and a heat exchange temperature difference of the indoor heat exchanger that are in a first heating state according to detecting values of the plurality of first sensors and a detecting value second sensor, the first heating state refers to a current heating state of the indoor unit;

the method further comprises:

in a case where the air conditioner is in a heating mode, determining an operating parameter of the indoor unit in a second heating state according to the heat exchange area, the heat exchange coefficient, and the heat exchange temperature difference of the indoor heat exchanger; the second heating state referring to a heating state in which the superheat degree of the inlet of the indoor heat exchanger is substantially equal to a second preset value, and the supercooling degree of the outlet of the indoor heat exchanger is substantially equal to a third preset value in the heating mode; the operating parameter of the indoor unit in the second heating state including a sensible heat load of the indoor unit in the second heating state; and determining an operating parameter of the indoor unit in the first heating state according to the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit in the second heating state.

18. The method according to claim 17, wherein determining the operating parameter of the indoor unit in the second heating state according to the heat exchange area, the heat exchange coefficient, and the heat exchange temperature difference of the indoor heat exchanger, includes:

determining second fitting parameters corresponding to the operating parameter of the indoor unit in the second heating state according to the heat exchange area and the heat exchange coefficient of the indoor heat exchanger; and determining the operating parameter of the indoor unit in the second heating state according to the second fitting parameters and the heat exchange temperature difference.

19. The method according to claim 17, wherein determining the operating parameter of the indoor unit in the first heating state according to the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit in the second heating state, includes:

correcting the operating parameter of the indoor unit in the second heating state according to a second correction parameter, a third correction parameter, the superheat degree of the inlet of the indoor heat exchanger in the first heating state, the supercooling degree of the outlet of the indoor heat exchanger in the first heating state, the superheat degree of the inlet of the indoor heat exchanger in the second heating state, the supercooling degree of the outlet of the indoor heat exchanger in the second heating state, and the operating parameter of the indoor unit in the second heating state, so as obtain the operating parameter of the indoor unit in the first heating state;

wherein the second correction parameter represents an influence of the superheat degree of the inlet of the indoor heat exchanger on the operating parameter of the indoor unit in the second heating state, and wherein the third correction parameter represents an influence of the supercooling degree of the outlet of the indoor heat exchanger on the operating parameter of the indoor unit in the second heating state.

20. The method according to claim 19, wherein the second correction parameter and the third correction parameter satisfy one of following:

the second correction parameter and the third correction parameter are constant values; and the second correction parameter and the third correction parameter each are related to the heat exchange area and the heat exchange coefficient of the indoor heat exchanger.

* * * * *